US005716775A

United States Patent [19]

Uehara et al.

[11] Patent Number: 5,716,775

[45] Date of Patent: Feb. 10, 1998

[54] HEAT-DEVELOPABLE COLOR LIGHT-SENSITIVE MATERIAL

[75] Inventors: Kazuki Uehara; Takuya Yokokawa, both of Kanagawa, Japan

[73] Assignee: Fuji Photo Film Co., Ltd., Kanagawa, Japan

[21] Appl. No.: 649,443

[22] Filed: May 17, 1996

[30] Foreign Application Priority Data

May 18, 1995 [JP] Japan ..... 7-119876
Aug. 23, 1995 [JP] Japan ..... 7-235939

[51] Int. Cl.[6] ..... G03C 1/498; G03C 1/34

[52] U.S. Cl. ..... 430/611; 430/203; 430/567

[58] Field of Search ..... 430/611, 203, 430/567, 569, 223

[56] References Cited

U.S. PATENT DOCUMENTS 4,198,240 4/1980 Mikawa ..... 430/611
5,061,614 10/1991 Takada et al. ..... 430/611
5,064,753 11/1991 Sohei et al. ..... 430/203

*Primary Examiner*—Thorl Chea
*Attorney, Agent, or Firm*—Sughrue, Mion, Zinn, Macpeak & Seas, PLLC

[57] ABSTRACT

A heat developable color light-sensitive material is disclosed, comprising a support having provided thereon at least a light-sensitive silver halide emulsion(s), a binder and a dye-donating compound, wherein at least one of the light-sensitive silver halide emulsion(s) (a) (a-1) comprises grains containing silver iodide in an amount of 0.1 mol % or more based on silver in the inside of the grains, and (a-2) contains at least one compound represented by formula (I-a), (I-b) or (I-c); or (b) (b-1) comprises silver chloroiodobromide grains containing silver iodide in an amount of 0.1 mol % or more based on silver in the inside of the grains and silver chloride in an amount of 10 mol % or more based on silver, (b-2) contains a sensitizing dye added before chemical sensitization, and (b-3) chemically sensitized in the presence of a nucleic acid decomposition product:

$$Z—SO_2.S—M \qquad \text{(I-a)}$$

The substituents Z and M in formula (I-a) are disclosed in the specification. Formulae (I-b) and (I-c) are also disclosed in the specification.

4 Claims, No Drawings

HEAT-DEVELOPABLE COLOR LIGHT-SENSITIVE MATERIAL

FIELD OF THE INVENTION

The present invention relates to a heat-developable color light-sensitive material. More specifically, the present invention relates to a heat-developable color light-sensitive material which is excellent in pressure property and low in the fogging upon heat development.

BACKGROUND OF THE INVENTION

Various heat-developable light-sensitive materials are known and, for example, such materials and light-sensitive processes of processing them are described in *Bases of Photographic Engineering*, Edition of Nonsilver Photography (published by Corona Publishing Co., 1982), pages 242 to 255 and U.S. Pat. No. 4,500,626.

In addition, a method for forming a color image by coupling reaction of an oxidation product of a developing agent and a coupler is described in, for example, U.S. Pat. Nos. 3,761,270 and 4,021,240. A method for forming a positive color image by a light-sensitive silver dye bleaching process is described in U.S. Pat. No. 4,235,957.

Recently, a dye transfer method for imagewise releasing or forming a diffusible dye by heat development followed by transferring the diffusible dye to a dye-fixing element has been proposed. In accordance with the method, both a negative color image and a positive color image can be obtained by varying the kind of the dye-donating compound to be used and the kind of the silver halide to be used. The details of the method are described in U.S. Pat. Nos. 4,500,626, 4,483,914, 4,503,137 and 4,559,290, JP-A-58-149046, JP-A-60-133449, JP-A-59-218443, JP-A-61-238056, EP-A-220746, *JIII Journal of Technical Disclosure* 87–6199 and EP-A-210660 (the term "JP-A" as used herein means an "unexamined published Japanese patent application").

In the heat development system, it has hitherto been difficult to obtain a heat-developable color light-sensitive material excellent in pressure property and low in the fogging upon heat development. The term "pressure property" as used herein means a capability with respect to the fog and the increase/decrease in sensitivity to be caused when a certain kind of pressure is applied onto the light-sensitive material. For example, the emulsions described in JP-A-6-242546 and JP-A-6-347969 comprising grains containing silver iodide on the surface thereof are insufficient in the pressure property. The emulsion described in JP-A-7-219182 is an emulsion comprising (111) faces and containing grains having a shell where silver iodide is uniformly present and this emulsion has succeeded in achieving high sensitivity; however, it is insufficient in the pressure property.

Also, a large number of methods have been proposed for the method for obtaining a positive color image by heat development. For example, U.S. Pat. No. 4,559,290 proposes a method for allowing a compound resulting from converting a so-called DRR compound into an oxidation type having no color image releasing ability to be present together with a reducing agent or a precursor thereof, oxidizing the reducing agent in accordance with the exposure amount of silver halide by heat development, and reducing the compound by the reducing agent remained unoxidized to release a diffusible dye. And, EP-A-220746 and *JIII Journal of Technical Disclosure* 87–6199 (Vol. 12, No. 22) describe a heat-developable color light-sensitive material using a compound which releases a diffusible dye by the reducing cleavage of N—X bond (wherein X represents an oxygen atom, a nitrogen atom or a sulfur atom), as a compound capable of releasing a diffusible dye in the same mechanism.

The heat-developable color light-sensitive material can be processed simply and rapidly in comparison with a normal light-sensitive material for wet developing and therefore, can be developed in a small-size and compact machine. Accordingly, relatively cheap machines are being developed and sold as a color copier or a color printer for the silver salt color light-sensitive material system. In order to achieve further expansion of use of these machines, various improvements are deemed to be necessary and one of them is the improvement of pressure property of the heat-developable color light-sensitive material. In general, when a pressure is applied onto a light-sensitive material, there are sometimes caused fogging (pressure fogging), increase in the sensitivity (pressure sensitization) or decrease in the sensitivity (pressure desensitization). This is because when a light-sensitive silver halide grain is pressed, fogging or increase/decrease in sensitivity is caused, and the deterioration is greater as the silver halide grain size is larger. The above-described pressure property (i.e., pressure fogging, pressure sensitization, pressure desensitization) may cause a problem such that scratches, sensitization streaks or desensitization streaks are generated on an image. In order to overcome these problems, an effort is being made to reduce the pressure to be applied on the light-sensitive material, for example, the shape of guide plate is reformed or the surface property is improved; however, the solving by the device on the machine is one of causes for raising the cost of machine. Accordingly, the improvement of pressure property of a heat-developable color light-sensitive material is, of which primary object is of course to improve the image quality, keenly demanded also in view of the reduction in cost of the machine.

A large number of methods for adding KI to the inside of a grain have hitherto been reported. However, according to conventional techniques, the pressure property of a silver chlorobromide emulsion is generally controlled by the core/shell structure or the surface conversion, and the addition of KI to the inside of a grain has not been investigated.

In particular, it is quite unknown that the pressure property is remarkably improved in an emulsion where a sensitizing dye is added before chemical sensitization.

The emulsion of which pressure property is improved by the above-described method is, however, bound to a problem of softness. The present invention has succeeded in preventing the softening of gradation by using a nucleic acid decomposition product.

SUMMARY OF THE INVENTION

An object of the present invention is to provide a heat-developable color light-sensitive material excellent in pressure property and low in the fogging upon heat development.

Another object of the present invention is to provide a heat-developable color light-sensitive material having excellent pressure property and containing an emulsion where a sensitizing dye is added before chemical sensitization and the pressure fog is improved without causing softening.

These and other objects of the present invention have been attained by a heat developable color light-sensitive material comprising a support having provided thereon at least a light-sensitive silver halide emulsion(s), a binder and a dye-donating compound, wherein at least one of the light-sensitive silver halide emulsion(s)

(a) (a-1) comprises grains containing silver iodide in an amount of 0.1 mol % or more based on silver in the inside of the grains; and (a-2) contains at least one compound represented by the following formula (I-a), (I-b) or (I-c); or (b) (b-1) comprises silver chloroiodobromide grains containing silver iodide in an amount of 0.1 mol % or more based on silver in the inside of the grains and silver chloride in an amount of 10 mol % or more based on silver; (b-2) contains a sensitizing dye added before chemical sensitization; and (b-3) chemically sensitized in the presence of a nucleic acid decomposition product:

$$Z-SO_2.S-M \quad \text{(I-a)}$$

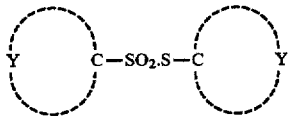

(I-b)

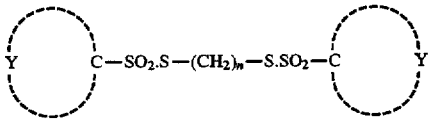

(I-c)

wherein Z represents an alkyl group, an aryl group or a heterocyclic group; Y represents a group necessary for forming an aromatic ring or a heterocyclic ring; M represents a metal atom or an organic cation; and n represents an integer of from 2 to 10. Preferably, the dye-donating compound releases a diffusible dye in correspondence to silver development.

DETAILED DESCRIPTION OF THE INVENTION

The specific structure of the present invention is described in detail below. The light-sensitive silver halide emulsion of the present invention is described below.

In the present invention, it is sufficient if at least one silver halide emulsion layer comprising silver halide grains containing silver iodide in the inside of a grain and having an average silver iodide content of 0.1 mol % or more is present on the support, and in other silver halide emulsion layers, any silver halide may be used.

In the definition of the silver halide emulsion of the present invention, the term "containing silver iodide in the inside of a grain" means that a portion containing silver iodide (in other words, a layer comprising pure silver iodide or halo silver iodide) is present in the inside of a grain and the silver iodide content on the grain surface is substantially 0 (zero).

In the above-described silver halide grains, the average silver iodide content to the silver of all grains is 0.1 mol % or more, preferably from 0.1 to 10 mol %, more preferably from 0.1 to 2 mol %, and most preferably from 0.2 to 2 mol %.

If the iodine ion content is too small, the effect of the present invention cannot be obtained, whereas if the iodine ion content is too large, disadvantageous effects may result such as softening, decrease in sensitivity or reduction in development rate.

In the silver halide grain constituting the silver halide emulsion of the present invention, the silver iodide-containing portion may be present at any site inside the grain.

The silver iodide-containing portion may be present in the inside of a grain as two or more layers.

The method for causing the presence of iodine ions in the inside of a grain includes a method for preparing a grain having a multiple structure such as core/shell structure and adding iodine ions to the inner layer, and a method for collectively adding iodine ions during the grain formation. The iodine ion include potassium iodide and sodium iodide. When the iodine ions are collectively added, a method for adding silver iodide or silver iodobromide fine grains and uniformly adding iodine ions while dissolving these fine grains is preferred. When the iodine ions are collectively added in the form of a solution, the solution is preferably diluted so that the iodine ions can be uniformly taken in throughout grains. The solution preferably has a concentration, in potassium iodide, of 2 wt % or less.

Furthermore, by optimizing the solubility (e.g., temperature, concentration of halogen in excess, silver halide solvent concentration during grain formation, gelatin concentration) during the grain formation at the time of addition of iodine ions, a further uniform emulsion having good pressure property can be obtained.

The halogen composition of the silver halide for use in the present invention preferably has a chlorine ion content of 10 mol % or more, more preferably from 10 to 50 mol %, and most preferably from 10 to 35 mol %, based on the silver. If the chlorine ion content is too small, the effect of the present invention cannot be obtained satisfactorily, whereas if the chlorine ion content is too large, disadvantageous effects may result such as increase of fog, decrease in the sensitivity and reduction in the development rate.

The silver halide grain of the present invention may have any crystal habit, for example, it may have a regular crystal system such as cubic, octahedral or tetradecahedral form, an irregular crystal system such as spherical form or tabular form having a high aspect ratio, a crystal defect such as twin plane, or a composite system thereof.

The grain size of the silver halide emulsion of the present invention is not particularly restricted; however, it is preferably from 0.1 to 5 μm, and more preferably from 0.2 to 3 μm.

When the silver halide grain of the present invention is tabular, the diameter/thickness ratio thereof is preferably 2 or more, more preferably from 2 to 50, still more preferably from 2 to 20, and most preferably from 3 to 10.

The term "diameter of silver halide grain" as used herein means a diameter of a circle having an area equal to the projected area of a grain. In the present invention, the diameter of a tabular silver halide grain is from 0.3 to 5 μm, preferably from 0.5 to 3 μm.

The thickness thereof is 0.4 μm or less, preferably 0.3 μm or less, and more preferably 0.2 μm or less. The average volume of volume loads of grains is preferably 2.0 $\mu m^3$ or less, and more preferably 1.0 $\mu m^3$ or less.

In general, the tabular silver halide grain has two parallel tabular planes and accordingly, the term "thickness" as used in the present invention means a distance between two parallel planes constituting the tabular silver halide grain.

The silver halide of the present invention may be any of silver iodobromide, silver chloroiodobromide and silver chloroiodide; however, it is preferably silver iodobromide or silver chloroiodobromide, more preferably silver iodobromide.

The silver halide grain of the present invention may be a so-called multiple structure grain different in the halogen composition between the inside of the grain and the surface of the grain. Out of multiple structure grains, those having a double structure is particularly called a core/shell emulsion.

The silver halide emulsion of the present invention may have either a polydispersed grain size distribution or a monodispersed grain size distribution, but a monodispersed grain size distribution preferred and the coefficient of variation described in JP-A-3-110555 is preferably 20% or less, more preferably 16% or less, and most preferably 10% or less. However, the present invention is by no means limited to the monodispersed emulsion.

The silver halide emulsion may be either a surface latent image-type emulsion or an internal latent image-type emulsion. The internal latent image-type emulsion is used as a direct reversal emulsion in combination with a nucleating agent or a light fogging agent.

Other properties of the emulsion of the present invention and other emulsions for use in the light-sensitive material of the present invention will be described later in detail.

Formulae (I-a), (I-b) and (I-c) of the present invention are described.

The alkyl group represented by Z is preferably an alkyl group having from 1 to 18 carbon atoms and the aryl group is preferably an aryl group having from 6 to 18 carbon atoms.

The aromatic ring represented by Y is preferably an aromatic ring having from 6 to 18 carbon atoms.

The alkyl, aryl and heterocyclic groups represented by Z and the aromatic and heterocyclic groups represented by Y in formulae (I-a), (I-b) and (I-c) each may be substituted.

Examples of the substituent include an alkyl group such as methyl and ethyl, an aryl group such as phenyl, an alkoxy group having from 1 to 8 carbon atoms, a halogen atom such as chlorine, a nitro group, an amino group and a carboxyl group.

Examples of the heterocyclic ring represented by Z or Y include a thiazole ring, a benzothiazole ring, an imidazole ring, a benzimidazole ring and an oxazole ring.

The metal atom represented by M is preferably an alkali metal atom such as sodium ion and potassium ion, and the organic cation is preferably an ammonium ion or a guanidine group.

Specific examples of the compounds represented by formulae (I-a), (I-b) and (I-c) are set forth below.

I-1

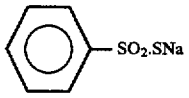

I-2

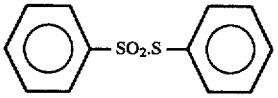

I-3

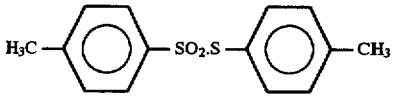

I-4

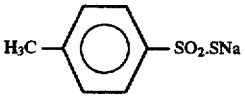

$H_3C.SO_2.SNa$ I-5

-continued

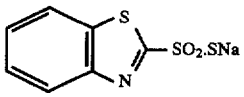

I-6

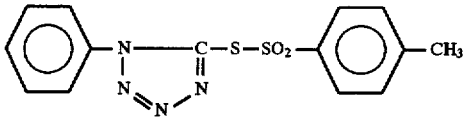

I-7

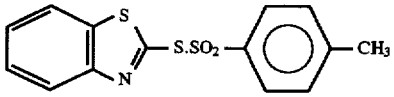

I-8

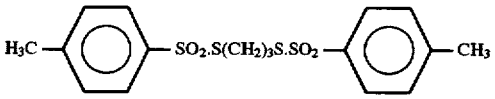

I-9

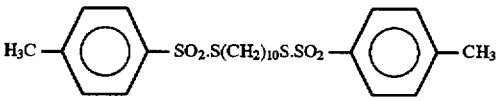

I-10

1-Cystine-disulfoxide I-11

The compounds represented by formulae (I-a), (I-b) and (I-c) can be synthesized by a commonly well known method.

For example, the compounds may be synthesized by reacting a corresponding sulfonyl fluoride with sodium sulfide or by reacting a corresponding sodium sulfinate with sulfur. Also, these compounds can be easily available as a commercial product.

The addition amount of the compound represented by formula (I-a), (I-b) or (I-c) of the present invention is preferably from $10^{-8}$ to $10^{-2}$ mol, and more preferably from $10^{-8}$ to $10^{-4}$ mol, per mol of silver halide.

The addition time of the compound may be any stage at the time of grain formation or chemical ripening of the emulsion; however, it is preferably added immediately before the initiation of chemical ripening.

The light-sensitive silver halide emulsion is subjected to spectral sensitization with a methine dye or the like to impart green-sensitive, red-sensitive or infrared-sensitive spectral sensitivity to the light-sensitive silver halide having the above-described specific halogen composition. Furthermore, the blue-sensitive emulsion may be subjected to spectral sensitization in the blue region, if desired. Furthermore, a plurality of sensitizing dyes different in the spectral sensitivity may be added, if desired.

Examples of the dye which can be used include a cyanine dye, a merocyanine dye, a complex cyanine dye, a complex merocyanine dye, a holopolar cyanine dye, a hemicyanine dye, a styryl dye and a hemioxonol dye.

Specific examples thereof include sensitizing dyes described in U.S. Pat. No. 4,617,257, JP-A-59-180550, JP-A-64-13546, JP-A-5-45828 and JP-A-5-45834.

These sensitizing dyes may be used individually or may be used in combination and the combination of sensitizing dyes are often used for supersensitization or control of the wavelength in spectral sensitization.

In combination with a sensitizing dye, a dye which itself has no spectral sensitization effect, or a compound which absorbs substantially no visible light, but exhibits supersensitization may be contained in the emulsion (for example, those described in U.S. Pat. No. 3,615,641, JP-A-63-23145).

The addition time of the sensitizing dye to the silver halide emulsion having the above-described specific halogen composition may be any stage if it is before chemical sensitization. For example, as described in U.S. Pat. Nos. 4,183,756 and 4,225,666, the sensitizing dye may be added before or after nucleation of silver halide grains. A method for adding the sensitizing dye in the latter half of grain formation or after grain formation of silver halide collectively or over several minutes or several ten minutes is preferably used in many cases; however, the present invention is by no means limited thereto.

The sensitizing dye may be added by installments, for example, after grain formation and before preparation of the coating solution, or during grain formation and before chemical sensitization. The sensitizing dye or the supersensitizing dye may be added as a solution of an organic solvent such as methanol, phenoxyethanol or ethanol, as a dispersion in gelatin or as a solution of a surface active agent. Simultaneously with or before or after the addition of the sensitizing dye, an organic solvent such as a halogen ion, a surface active agent or methanol may be added. The addition amount of the sensitizing dye is approximately from $10^{-8}$ to $10^{-2}$ mol per mol of silver halide. Other properties are the same as those in silver halide for use in normal emulsion which will be described later.

Specific examples of the sensitizing dye are set forth below; however, the present invention is by no means limited thereto.

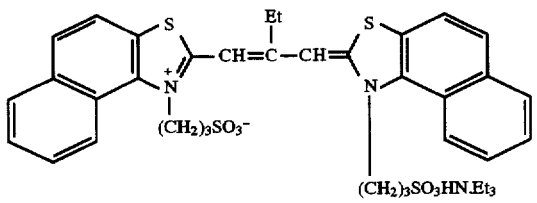

(1)

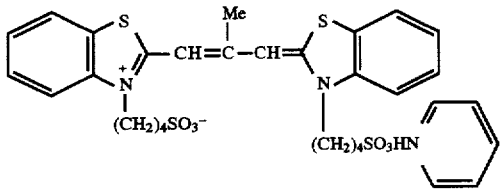

(2)

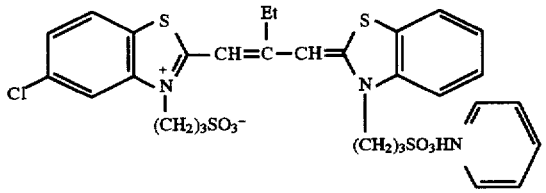

(3)

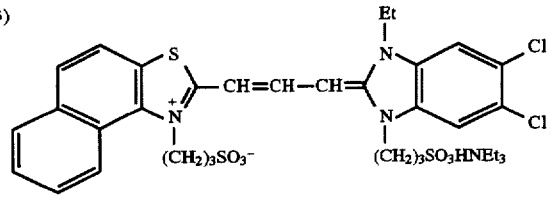

(4)

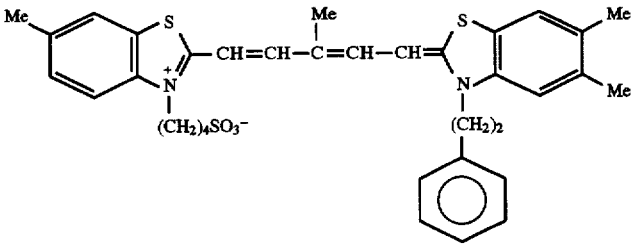

(5)

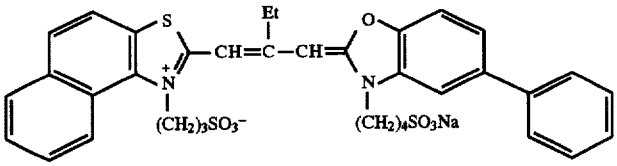

(6)

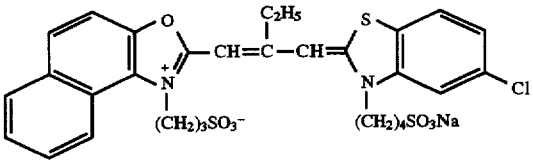

(7)

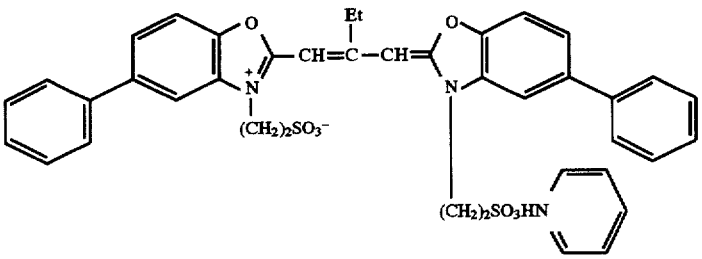

(8)

-continued
(9)
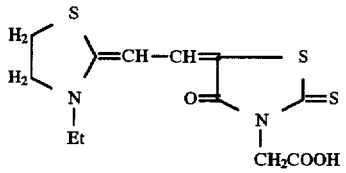
(10)
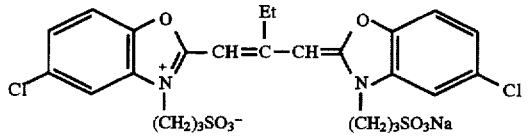
(11)
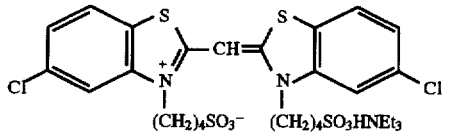
(12)
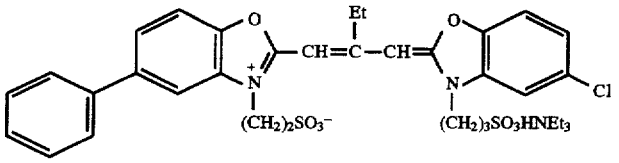
(13)
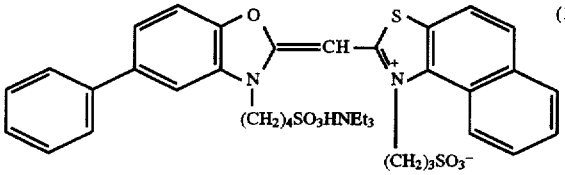
(14)
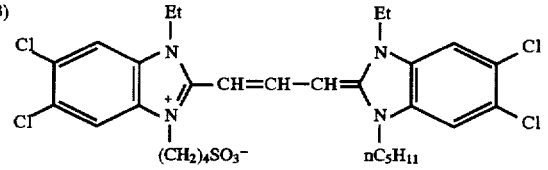
(15)
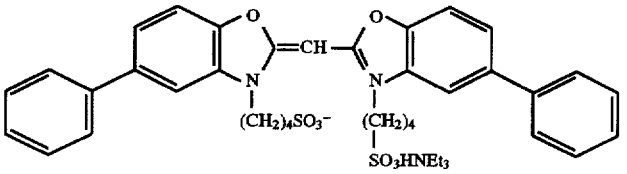
(16)
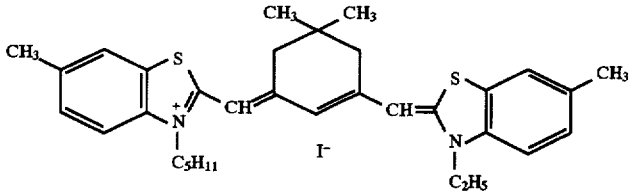
(17)
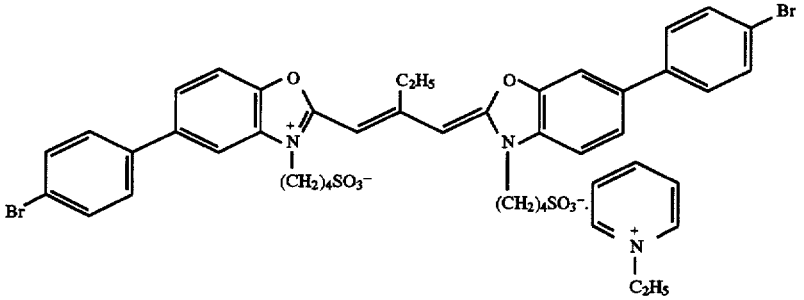
(18)
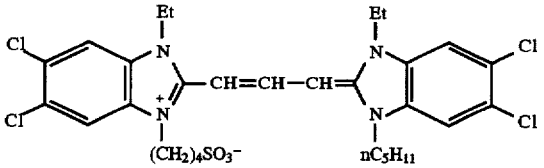
(19)
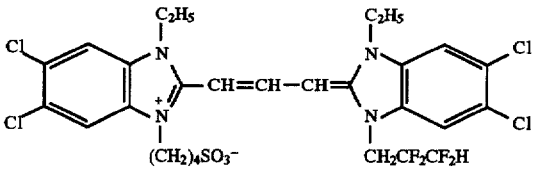

-continued

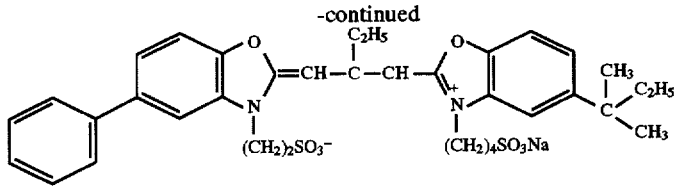

(20)

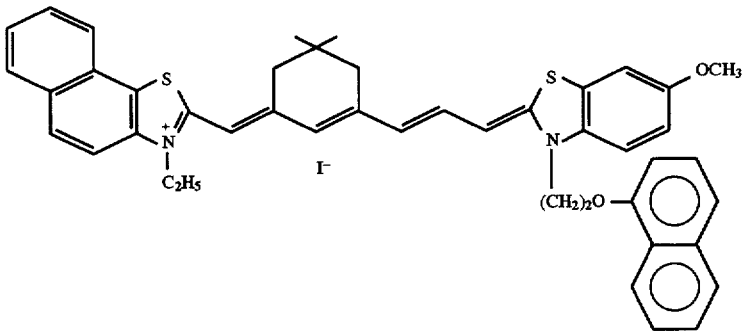

(21)

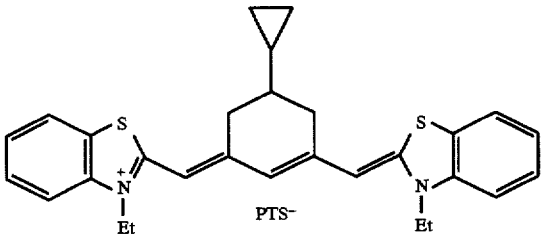

(22)

The nucleic acid is a high polymer compound playing an important role in the synthesis of protein in a living body. The nucleic acid has a molecular weight of 1,000,000 or more. Various decomposition products resulting from the decomposition of a nucleic acid under an alkali condition are conventionally known to appropriately suppress the chemical sensitization and to be useful in obtaining a preferred photographic property. The decomposition product of the nucleic acid is described in detail in Shinichi Kikuchi, Shashin Kaqaku, Kyoritsu Shuppan (1981).

In the emulsion of the present invention, the addition amount of the nucleic acid decomposition product is from 0.03 to 3 g, preferably from 0.1 to 1 g, per mol of silver halide. The nucleic acid decomposition product is usually added as a solution such as an aqueous alkali solution; however, it may be added as a gelatin dispersion.

The addition time of the nucleic acid decomposition product is preferably before or during chemical sanitization, most preferably about 20 minutes before chemical sensitization.

The heat-developable color light-sensitive material of the present invention fundamentally has a light-sensitive silver halide, a binder, a reducing agent and a dye-donating compound on a support, and if desired, an organic metal salt oxidizing agent may be incorporated thereinto. These components are added to the same layer in many cases; however, they may be added to separate layers if they remain in the reactive state with each other. For example, when a colored dye-donating compound is present in a layer under silver halide emulsion, the reduction in sensitivity is prevented. The reducing agent is preferably incorporated into a heat-developable light-sensitive element; however, it may be supplied from the exterior, for example, by a method for diffusing it from a dye fixing material which will be described later.

In order to obtain colors over a wide range within the chromaticity diagram using three primary colors of yellow, magenta and cyan, at least three silver halide emulsion layers having light sensitivity in different spectral regions are used in combination. In the present invention, a three-layer combination of a blue-sensitive layer, a green-sensitive layer and a red-sensitive layer is used. Respective light-sensitive layers may be arranged in various orders known for the normal color light-sensitive layer. Each light-sensitive layer may be divided into two or more layers, if desired.

Particularly, in a method commonly used, a silver halide emulsion having spectral sensitivity in the wavelength of from 400 to 500 nm (blue-sensitive emulsion) is incorporated into a light-sensitive layer containing a yellow dye-donating compound, a silver halide emulsion having spectral sensitivity in the region of from 500 to 600 nm (green-sensitive emulsion) into a light-sensitive layer containing a magenta dye-donating compound and a silver halide emulsion having spectral sensitivity in the region of from 600 to 740 nm (red-sensitive emulsion) into a light-sensitive layer containing a cyan dye-donating compound. In this case, since the yellow light-sensitive layer is colored yellow, it is preferably an uppermost light-sensitive layer farthest from the support.

More specifically, the order is from the support a red-sensitive layer containing a cyan dye-donating compound, an interlayer, a green-sensitive layer containing a magenta dye-donating compound, an interlayer, a blue-sensitive layer containing a yellow dye-donating compound, an interlayer and a protective layer.

Even if the cyan layer and the magenta layer are reversed, the same property is provided. Each light-sensitive layer may comprise two layers, and each layer may contain a dye-donating compound and a halide emulsion, or it is also possible that the upper layer only contains a halide emulsion and the lower layer contains a dye-donating compound to achieve high sensitivity.

The heat-developable color light-sensitive material comprises various auxiliary layers such as a protective layer, an undercoat layer, an interlayer, a yellow filter layer, an antihalation layer and a back layer.

In the case when the support is a polyethylene-laminated paper containing a white pigment such as titanium oxide, the back layer must be designed to have an antistatic function and a surface resistivity of $10^{12}$ Ω·cm or less.

The emulsion which can be used in combination with the above-described silver halide emulsion in the heat-developable color light-sensitive material of the present invention is described in detail below (in using this emulsion in combination, it is preferably used in a separate layer from the above-described silver halide emulsion).

The silver halide for use in the present invention may be any of silver chloride, silver bromide, silver iodobromide, silver chlorobromide, silver chloroiodide and silver chloroiodobromide.

The silver halide emulsion for use in the present invention may be either a surface latent image type emulsion or an internal latent type emulsion. The internal latent type emulsion is used as a direct reversal emulsion, in combination with a nucleating agent or with light fogging. The emulsion may also be a so-called core/shell emulsion in which the inside phase and the surface phase of each grain are different from each other, or an emulsion comprising epitaxial grains grown by epitaxial conjugation to have different silver halides. The silver halide emulsion may be either a monodispersed one or a polydispersed one. In the preparation of the emulsion, a method for blending plural monodispersed emulsions is preferably used for adjusting the gradation of the emulsion mix as described in JP-A-1-167743, JP-A-4-223463. The grain size of emulsion grains may be from 0.1 to 2 μm, especially preferably from 0.2 to 1.5 μm. Regarding the crystal habit of silver having halide grains, the grains may be regular crystalline ones such as cubic, octahedral or tetradecahedral ones, or irregular crystalline ones such as spherical ones or tabular ones having a high aspect ratio, or twin-crystalline ones having crystal defects, or composite ones composed of such grains.

Concretely, usable in the present invention are all silver halide emulsions prepared by the methods described in, for example, U.S. Pat. No. 4,500,626 (column 50), 4,628,021; RD No. 17029 (1978), RD No. 17643 (December, 1978), pages 22 and 23, RD No. 18716 (November, 1979), page 648, RD No. 307105 (November, 1989), pages 863 to 865; JP-A-62-253159, JP-A-64-13546, JP-A-2-236546, JP-A-3-110555; P. Glafkides, Chemie et *Phisique Photographigue* (Paul Montel, 1967); G. F. Duffin, *Photographic Emulsion Chemistry* (Focal Press, 1966); V. L. Zelikman et al., *Making and Coating Photographic Emulsion* (Focal Press, 1964).

All silver halide grains for use in the heat-developable color light-sensitive material of the present invention will be explained below.

The light-sensitive silver halide emulsions for use in the present invention are preferably de-salted so as to remove the excess salts therefrom. For the de-salting, for example, employable are a noodle-washing method where gelatin is gelled and a flocculation method using polyanionic inorganic salts (e.g., sodium sulfate), anionic surfactants, anionic polymers (e.g., sodium polystyrenesulfonate) or gelatin derivatives (e.g., aliphatic acylated gelatins, aromatic acylated gelatins, aromatic carbamoylated gelatins). The flocculation method is preferred.

The light-sensitive silver halide emulsions for use in the present invention may contain heavy metals, such as iridium, rhodium, platinum, cadmium, zinc, thallium, lead, iron, and osmium, for various purposes. Compounds of such heavy metals may be added to the emulsions singly or as a mixture of two or more of them. The amount of the compounds to be added varies, depending on the object, and is, in general, approximately from $10^{-9}$ to $10^{-3}$ mol per mol of the silver halide in the emulsion. The compounds may be incorporated uniformly into the silver halide grains or locally into or onto the insides or the surfaces of the grains. Concretely, preferred are the emulsions described in JP-A-2-236542, JP-A-1-116637 and JP-A-5-181246.

The addition amount of iridium for use in the present invention is preferably from $10^{-9}$ to $10^{-4}$ mol, and more preferably from $10^{-8}$ to $10^{-6}$ mol, per mol of silver halide. In a core/shell emulsion, the iridium may be added to the core and/or the shell. Preferred examples of the iridium compound include $K_2IrCl_6$ and $K_3IrCl_6$.

The addition amount of rhodium for use in the present invention is preferably from $10^{-9}$ to $10^{-6}$ mol per mol of silver halide.

The addition amount of iron for use in the present invention is preferably from $10^{-7}$ to $10^{-3}$, more preferably from $10^{-6}$ to $10^{-3}$ mol, per mol of silver halide.

A method where a part or whole of the above-described heavy metal is previously doped to a fine grain emulsion of silver chloride, silver chlorobromide, silver bromide or silver iodobromide and the fine grain emulsion is added to locally dope the metal onto the silver halide emulsion surface, is also preferably used.

At the stage of forming the grains of the light-sensitive silver halide emulsions for use in the present invention, rhodanates, ammonia, 4-substituted thioether compounds, organic thioether derivatives described in JP-B-47-11386 (the term "JP-B" as used herein means an "examined Japanese patent publication"), and sulfur-containing compounds described in JP-A-53-144319 can be used as a silver halide solvent.

For other conditions in preparing the silver halide emulsions for use in the present invention, referred to are the disclosures in the above-described, P. Glafkides, Chemie et *Phisique Photographique* (Paul Montel, 1967); G. F. Duffin, *Photographic Emulsion Chemistry* (Focal Press, 1966); and V. L. Zelikman et al., *Making and Coating Photographic Emulsion* (Focal Press, 1964). For instance, employable is any of an acid method, a neutral method and an ammonia method. As the system of reacting soluble silver salts and soluble halides, employable is any of a single jet method, a double jet method and a combination of these. A double jet method is preferably used for preparing monodispersed emulsions.

A reversed mixing method may be also used for forming silver halide grains in the presence of excess silver ions. As one system of a double jet method, a controlled double jet method in which the pAg value in the liquid phase to give silver halide grains is kept constant may be used.

The concentration, the amount and the addition speeds of silver salts and halides to be added may be increased as described in, for example, JP-A-55-142329, JP-A-55-158124, and U.S. Pat. No. 3,650,757 for acceleration of the growth of grains.

Any known stirring method may be used for stirring the reaction system in the formation of silver halide grains. The temperature and the pH value of the reaction system may be determined at any desired ones during the formation of silver halide grains, in accordance with the object. Preferably, the pH value of the system is form 2.2 to 8.5, more preferably from 2.5 to 7.5.

The light-sensitive silver halide emulsions for use in the present invention are, in general, chemically sensitized. Any of chalcogen sensitization such as sulfur sensitization, selenium sensitization and tellurium sensitization, noble metal sensitization using gold, platinum or palladium, and reduction sensitization, which are known to be employable for sensitizing ordinary light-sensitive emulsions, can be used alone or in combination thereof for chemically sensitizing the emulsions. For the chemical sensitization, for example, the disclosures in JP-A-3-110555 and JP-A-5-241267 are referred to. The chemical sensitization may be carried out in the presence of nitrogen-containing heterocyclic compounds as described in JP-A-62-253159. In addition, an antifoggant which will be mentioned hereinafter can be added to the chemically-sensitized emulsions. For example, the methods described in JP-A-5-45833 and JP-A-62-40446 are used.

During the chemical sensitization, the pH value of the emulsion to be sensitized is preferably from 5.3 to 10.5, more preferably from 5.5 to 8.5; and the pAg value thereof is preferably from 6.0 to 10.5, more preferably 6.8 to 9.0.

In the light-sensitive material of the present invention, the amount of the light-sensitive silver halide emulsions to be coated is from 1 mg/m$^2$ to 10 g/m$^2$ in terms of silver.

The light-sensitive silver halide emulsions for use in the present invention may be color-sensitized with, for example, methine dyes, by which the silver halide grains therein are made green-sensitive, red-sensitive or infrared-sensitive. In addition, the blue-sensitive emulsion may also be color-sensitized to make it sensitive to blue light, if needed.

Examples of the dyes include cyanine dyes, merocyanine dyes, complex cyanine dyes, complex merocyanine dyes, holopolar cyanine dyes, hemicyanine dyes, styryl dyes and hemioxonol dyes.

Specific examples thereof include sensitizing dyes described in U.S. Pat. No. 4,617,257, JP-A-59-180550, JP-A-64-13546, JP-A-5-45828, and JP-A-5-45834.

These sensitizing dyes may be used alone or in combination thereof. The combination of plural sensitizing dyes is often used for super-color sensitization or for controlling the wavelength range in spectral sensitization.

Dyes which do not have a color-sensitizing activity by themselves or compounds which do not substantially absorb visible rays but which show a super-color sensitizing activity may be incorporated into emulsions along with sensitizing dyes. Examples thereof are described in U.S. Pat. No. 3,615,641 and JP-A-63-23145.

The time of adding the sensitizing dyes into emulsions may be before or after chemical ripening of emulsions. It may be before or after formation of nuclei of silver halide grains according to U.S. Pat. Nos. 4,183,756 and 4,225,666. These dyes and super-color sensitizers can be added to emulsions as their solution in organic solvents such as methanol, their dispersions in gelating or their solutions containing surfactants. Their amounts to be added may be from $10^{-8}$ to $10^{-2}$ mol per mol of the silver halide in the emulsion.

Additives usable in these steps as well as other known light-sensitive additives usable in preparing the heat-developable light-sensitive material of the present invention and dye-fixing (image-receiving) materials are described in the above-described RD Nos. 17643, 18716 and 307105, and the relevant parts in these RDs are mentioned below.

| Additives | RD 17643 | RD 18716 | RD 307105 |
|---|---|---|---|
| 1. Chemical Sensitizer | p. 23 | p. 648, right column (RC) | p. 866 |
| 2. Sensitivity Increasing Agent | | p. 648, right column (RC) | |
| 3. Spectral Sensitizer, Supersensitizer | pp. 23–24 | p. 648, RC to p. 649, RC | pp. 866–868 |
| 4. Brightening Agent | p. 24 | p. 648, RC | p. 868 |
| 5. Antifoggant, Stabilizer | pp. 24–25 | p. 649, RC | pp. 868–870 |
| 6. Light Absorbent, Filter Dye, Ultraviolet Absorbent | pp. 25–26 | p. 649, RC to p. 650, left column (LC) | p. 873 |
| 7. Dye Image Stabilizer | p. 25 | p. 650, LC | p. 872 |
| 8. Hardening Agent | p. 26 | p. 651, LC | pp. 874–875 |
| 9. Binder | p. 26 | p. 651, LC | pp. 873–874 |
| 10. Plasticizer, Lubricant | p. 27 | p. 650, RC | p. 876 |
| 11. Coating Aid, Surface Active Agent | pp. 26–27 | p. 650, RC | p. 875–876 |
| 12. Antistatic Agent | p. 27 | p. 650, RC | pp. 876–877 |
| 13. Matting Agent | p. 27 | p. 650, RC | pp. 878–879 |

Preferably, the binder in the layers of constituting heat-developable light-sensitive materials and dye-fixing materials is hydrophilic. Examples thereof are described in the above-described *Research Disclosures* and JP-A-64-13546, pages 71 to 75. Concretely, transparent or semi-transparent hydrophilic binders are preferred. Specific examples thereof include natural compounds, such as proteins (e.g., gelatin, gelatin derivatives), and polysaccharides (e.g., cellulose derivatives, starch, gum arabic, dextran, pullulane); and synthetic polymer compounds (e.g., polyvinyl alcohol, polyvinyl pyrrolidone, acrylamide polymers). In addition, highly water-absorbing polymers described in U.S. Pat. No. 4,960,681 and JP-A-62-245260, such as homopolymers of vinyl monomers having —COOM or —$SO_3M$ (wherein M is a hydrogen atom or an alkali metal), or copolymers of such vinyl monomers or copolymers of such vinyl monomers along with other vinyl monomers (e.g., sodium methacrylate, ammonium methacrylate, Sumikagel L-5H produced by Sumitomo Chemical Co., Ltd.) may also be used. These binders may be used in combination of two or more of them. Gelatin may be selected from lime-processed gelatin, acid-processed gelatin and delimed gelatin having a reduced content of calcium, if needed. These gelatins may be also preferably used in combination.

When a system of effecting heat development while applying a slight amount of water thereto is employed in carrying out the present invention, the light-sensitive material of the present invention is desired to contain the high water-absorbing polymer because the material containing such a high water-absorbing polymer can absorb water rapidly. It is also preferred to incorporate the high water-absorbing polymer into the dye-fixing layer and the protective layer therefor because the dye transferred to the dye-fixing material containing such a high water-absorbing polymer in the dye-fixing layer is prevented from being again transferred to other materials.

In the light-sensitive material of the present invention, the amount of the binder to be coated is preferably 20 g or less, more preferably 10 g or less, and most preferably from 0.5 g to 7 g, per m$^2$ of the material.

In the present invention, an organic metal salt may be used as an oxidizing agent with the light-sensitive silver halide emulsion. Of the organic metal salts, organic silver salts are particularly preferred.

Examples of the organic compounds used for forming the organic silver salt oxidizing agents include benzotriazoles, fatty acids and other compounds described in U.S. Pat. No. 4,500,626 (columns 52 and 53). In addition, acetylene silver described in U.S. Pat. No. 4,775,613 is also useful. The organic silver salts may be used in combination of two or more of them.

The above-described organic silver salt may be added to the emulsion in an amount of from 0.01 to 10 mol, preferably from 0.01 to 1 mol, per mol of the light-sensitive silver halide. The total amount of the light-sensitive silver halide emulsion and the organic silver salt coated is from 0.05 to 10 $g/m^2$, more preferably from 0.1 to 0.4 $g/m^2$, in terms of silver.

Examples of the reducing agent for use in the present invention include those known in the field of heat-developable light-sensitive materials can be used. The reducing agent also includes dye-donating compounds having a reducing property described below (in this case, other reducing agent(s) can be used in combination). In addition, reducing agent precursors which do not have a reducing property by themselves but which show a reducing capacity by the action of a nucleating reagent or heat during the step of development may also be used.

Examples of the reducing agents for use in the present invention include reducing agents and reducing agent precursors as described in U.S. Pat. Nos. 4,500,626 (columns 49 and 50), U.S. Pat. No. 4,483,914 (columns 30 and 31), U.S. Pat. No. 4,330,617 and 4,590,152, JP-A-60-140355 (pages 17 and 18), JP-A-57-40245, JP-A-56-138736, JP-A-59-178458, JP-A-59-53831, JP-A-59-182449, JP-A-59-182450, JP-A-60-119555, JP-A-60-128436 through JP-A-60-128439, JP-A-60-198540, JP-A-60-181742, JP-A-61-259253, JP-A-62-244044 and JP-A-62-131253, JP-A-62-131256, JP-A-63-10151, JP-A-64-13546 (pages 40 to 57), JP-A-1-120553, JP-A-2-32338, JP-A-2-35451, JP-A-2-234158, JP-A-3-160443 and EP-A-220746 (pages 78 to 96).

Combinations of various reducing agents described in U.S. Pat. No. 3,039,869 can also be employed.

When non-diffusible reducing agents are used in accordance with the present invention, an electron-transferring agent and/or an electron-transferring agent precursor can be used in combination for accelerating the movement of electrons between the non-diffusible reducing agent and the heat-developable silver halide. Those described in U.S. Pat. No. 5,139,919, EP-A-418743, JP-A-1-138556 and JP-A-3-102345 are especially preferred. In addition, the method in which these agents are stably incorporated into a layer as described in JP-A-2-230143 and JP-A-2-235044 are preferred.

The electron-transferring agent or precursor thereof can be selected from the above-described reducing agents and precursors thereof. The electron-transferring agent or precursor thereof is desired to have a higher mobility than the non-diffusible reducing agent (electron donor). Especially useful electron-transferring agents are 1-phenyl-3-pyrazolidones and aminophenols.

The non-diffusible reducing agent (electron donor) employed in combination with the electron-transferring agent may be any one of the above-described reducing agents which are substantially immobile in the layers of a light-sensitive material. Preferable examples thereof include hydroquinones, sulfonamidophenols, sulfonamidonaphthols and the compounds described in JP-A-53-110827, U.S. Pat. Nos. 5,032,487, 5,026,634 and 4,839,272 as electron donors, and non-diffusible and reducing dye-donating compounds described below.

Furthermore, an electron donor precursor as described in JP-A-3-160443 may be preferably used.

Moreover, the reducing agents may be used in an interlayer or a protective layer for various purposes such as prevention of color mixing, improvement in color reproducibility, improvement in the properties of white background and prevention of silver migration to the dye-fixing material. Specifically, reducing agents as disclosed in EP-A-524649, EP-A-357040, JP-A-4-249245, JP-A-2-64633, JP-A-2-46450, and JP-A-63-186240 are preferably used. Furthermore, development inhibitor-releasing reducing compounds as described in JP-B-3-63733, JP-A-1-150135, JP-A-2-110557, JP-A-2-64634, JP-A-3-43735, and EP-A-451833 may be used.

In the present invention, the total amount of the reducing agent is from 0.01 to 20 mol, preferably from 0.1 to 10 mol, per mol of silver.

In the present invention, at the time of reducing silver ions to silver in the high temperature state, a compound which releases a diffusible dye in correspondence to the reaction, namely, a dye-donating compound, is used.

Particularly preferred compounds of the yellow dye-donating compound are represented by the following formula (1):

$$((\mathrm{Dye})_p\text{—}X)_q\text{—}Y_1 \qquad (1)$$

wherein Dye represents a dye or dye precursor group represented by the following formula (2); $Y_1$ represents a group which causes a difference in diffusibility of the dye component corresponding to reduction of a light-sensitive silver halide having a latent image imagewise to silver; X represents a single bond or a linking group; p represents an integer of 1 or more; and q represents 1 or 2, with the proviso that, when p is 2 or more or when q is 2, the plurality of Dye's or $((\mathrm{Dye})_p\text{—}X)$'s may be the same or different:

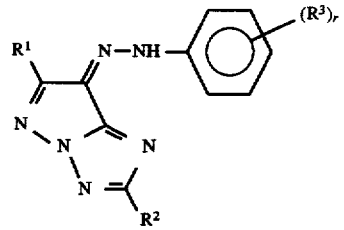

wherein $R^1$ and $R^2$ are the same or different, and each represents a hydrogen atom, a halogen atom, a hydroxyl group, a cyano group, a nitro group, a carboxyl group, or a substituent selected from the group consisting of an alkyl group, an aralkyl group, a cycloalkyl group, an aryl group, a heterocyclic group, an alkoxy group, an aryloxy group, an amino group, an acylamino group, a sulfonylamino group, an acyl group, a sulfonyl group, a carbamoyl group, a sulfamoyl group, a ureido group, an alkylthio group and an arylthio group, in which the substituent may be substituted; and $R^3$ has the same meaning as $R^1$ and $R^2$, with the proviso that $R^3$ is not a hydrogen atom; r represents an integer of from 0 to 5, with the proviso that when r is an integer of from 2 to 5, the plurality of $R^3$'s may the same or different. Dye and X in formula (1) are bonded at the position of $R^1$, $R^2$ or $R^3$ in formula (2).

The cyan dye-donating compound, the magenta dye-donating compound, and the yellow dye-donating compound which can be used in the present invention other than those represented by formula (1) are described below.

These dye-donating compounds each has fundamentally the same structure as formula (1) and the Dye moiety represents a cyan, magenta or yellow dye other than those represented by formula (2) or a precursor thereof. The cyan, magenta or yellow dye or a precursor thereof may be a known compound. Examples thereof include the following.

Examples of the yellow dye:

those described in U.S. Pat. Nos. 3,597,200, 3,309,199, 4,013,633, 4,245,028, 4,156,609, 4,139,383, 4,195,992, 4,148,641, 4,148,643 and 4,336,322, JP-A-51-114930, JP-A-56-71072, *Research Disclosure*, No. 17630 (1978), and ibid., No. 16475 (1977).

Examples of the magenta dye:

those described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104 and 4,287,292, JP-A-52-106727, JP-A-53-23628, JP-A-55-36804, JP-A-56-73057, JP-A-56-71060 and JP-A-55-134.

Examples of the cyan dye:

those described in U.S. Pat. Nos. 3,482,972, 3,929,760, 4,013,635, 4,268,625, 4,171,220, 4,242,435, 4,142,891, 4,195,994, 4,147,544 and 4,148,642, British Patent 1,551,138, JP-A-54-99431, JP-A-52-8827, JP-A-53-47823, JP-A-53-143323, JP-A-54-99431, JP-A-56-71061, European Patents (EPO) 53037 and 53040, *Research Disclosure*, No. 17630 (1978) and ibid., No. 16475 (1977).

Specific examples of the dye of which light absorption is temporarily shifted in the light-sensitive element, as one of dye precursors, are described in U.S. Pat. Nos. 4,310,612, 3,336,287, 3,579,334 and 3,982,946, British Patent 1,467,317 and JP-A-57-158638.

A further example of the dye-donating compound includes a compound having a property of imagewise releasing a diffusible dye represented by the following formula (LI):

$$((\text{Dye}')_s—\text{Y}')_t—\text{Z}' \quad \text{(LI)}$$

wherein Dye' represents a dye group or dye precursor group whose wavelength has been temporarily shortened; Y' represents a single bond or a linking group; Z' represents a group which causes a difference in diffusibility of the compound represented by $((\text{Dye}')_s—\text{Y}')_t—\text{Z}'$ or a group which releases $(\text{Dye}')_s—\text{Y}'$ and causes a difference in diffusibility between released $(\text{Dye}')_s—\text{Y}'$ and $((\text{Dye}')_s—\text{Y}')_t—\text{Z}'$, each corresponding to reduction of a light-sensitive silver halide having a latent image imagewise to silver; s represents an integer of 1 to 5; and t represents 1 or 2, with the proviso that, when either of s and t is not 1, the plurality of Dye' groups may be the same or different.

Specific examples of the dye-donating compounds represented by formula (LI) include the following compounds (1) and (2).

(1) Non-diffusible compounds (DDR couplers) which is a coupler having a diffusible dye as a releasing group and releases the diffusible dye by reaction with an oxidation product of a reducing agent are also useful. Examples thereof are described in British Patent 1,330,524, JP-B-48-39165 and U.S. Pat. Nos. 3,443,940, 4,474,867 and 4,483,914.

(2) Non-diffusible compounds (DRR compounds) which reduces silver halides or organic silver salts and releases a diffusible dye after having reduced the halides or salts can be also used. Examples thereof are described in U.S. Pat. Nos. 3,928,312, 4,053,312, 4,055,428 and 4,336,322, JP-A-56-65839, JP-A-59-69839, JP-A-53-3819 and JP-A-51-104343, RD No. 17465 (October, 1978), U.S. Pat. Nos. 3,725,062, 3,728,113 and 3,443,939, JP-A-58-116537, JP-A-57-179840 and U.S. Pat. No. 4,500,626. Specific examples of the DRR compounds are those described in the above-described U.S. Pat. No. 4,500,626 at columns 22 to 44 are useful, and among them, Compounds (1) to (3), (10) to (13), (16) to (19), (28) to (30), (33) to (35), (38) to (40), and (42) to (64) are preferred. In addition, the compounds described in U.S. Pat. No. 4,639,408 at columns 37 to 39 are also useful. Also, dye-donating compounds other than the above-described couplers and the compounds represented by formula (LI) used in the present invention include dye-silver compounds comprising an organic silver salt and a dye bonded to each other (RD of May 1978, pages 54 to 58), azo dyes employable in a heat-developable silver dye bleaching method (U.S. Pat. No. 4,235,957, RD of April 1976, pages 30 to 32) and leuco dyes (U.S. Pat. Nos. 3,985,565 and 4,022,617).

In the present invention, the DRR compounds are particularly preferred.

Hydrophobic additives such as the dye-donating compound and non-diffusible reducing agent can be incorporated into the layers of the light-sensitive material by any known method, for example, by the method described in U.S. Pat. No. 2,322,027. In this case, high boiling point organic solvents such as those described in U.S. Pat. Nos. 4,555,470, 4,526,466 4,526,467, 4,587,206, 4,555,476 and 4,599,296 and JP-B-3-62256 can be used, optionally together with low boiling point organic solvents having a boiling point of from 50° C. to 160° C. These dye-donating compound, non-diffusible reducing agent, and high and low boiling point organic solvents may be used in combination of two or more thereof.

The amount of the high boiling point organic solvent used is 10 g or less, preferably 5 g or less, and more preferably from 0.1 g to 1 g, per gram of the dye-donating compound used; and 1 ml or less, preferably 0.5 ml or less, and more preferably 0.3 ml or less, per gram of the binder.

In addition, a dispersion method with a polymer, as described in JP-B-51-39853 and JP-A-51-59943, and a method added as fine particle dispersion, as described in JP-A-62-30242, may also be employed.

When a compound to be incorporated into the layers of the heat-developable material of the present invention is substantially insoluble in water, it may be dispersed in the binder in the form of fine grains, in addition to the above-described methods.

When the hydrophobic compound is dispersed in a hydrophilic colloid, various surfactants may be used. For instance, surfactants described in JP-A-59-157636, pages 37 and 38 and the above-described RDs may be used for such purpose.

The light-sensitive material of the present invention can contain a compound having a function of activating the developability thereof and of stabilizing the image formed. Examples of such compounds which can preferably be employed in the present invention are described in U.S. Pat. No. 4,500,626 at columns 51 and 52.

In the system of forming an image by diffusion and transfer of the dye, various compounds may be incorporated in the layers constituting the heat-developable light-sensitive material for fixing or making undesirable dyes or colored matters colorless to improve the properties of the white background of the resulting image. Examples thereof are described in EP-A-353741, EP-A-461416, JP-A-63-163345 and JP-A-62-203158.

The layers constituting the heat-developable light-sensitive material according to the present invention can also comprise various pigments or dyes for improving color separatability or raising sensitivity.

Specifically, compounds described in the above cited RDs, and compounds and layer structures described in EP-A-479167, EP-A-502508, JP-A-1-167838, JP-A-4-343355, JP-A-2-168252, JP-A-61-20943, EP-A-479167 and EP-A-502508 may be used.

In the system of forming an image by diffusion and transfer of the dye, a dye-fixing material is employed together with the heat-developable light-sensitive material of the present invention. Such systems can be classified into two major categories, a format in which the light-sensitive material and the dye-fixing material are separately disposed on two independent supports and a format in which the two materials are provided as coating layers on one and the same support. As regards the relation between the light-sensitive material and the dye-fixing material, the relation thereof to the support and the relation thereof to a white reflective layer, those described in U.S. Pat. No. 4,500,626 at column 57 are useful in the present invention.

The dye-fixing material which is preferably used in the present invention has at least one layer containing a mordant agent and a binder. As the mordant, any one known in the photographic field can be employed, and specific examples thereof include mordant agents described in U.S. Pat. No. 4,500,626 at columns 58 and 59, JP-A-61-88256, pages 32 to 41 and JP-A-1-161236, pages 4 to 7; and those described in U.S. Pat. Nos. 4,774,162, 4,619,883 and 4,594,308. In addition, dye-receiving high polymer compounds, for example, those described in U.S. Pat. No. 4,463,079, can also be employed.

The hydrophilic binder is preferably used as the binder used in the dye-fixing material according to the present invention. Furthermore, carrageenans described in EP-A-443529, and latexes having a glass transition temperature of 40° C. or less described in JP-B-3-74820 may be preferably used.

The dye-fixing material may have auxiliary layers such as a protective layer, a peeling layer, an undercoating layer, an intermediate later, a backing layer and a curling preventing layer, if needed. In particular, a protective layer is preferably provided.

The layers constituting the heat-developable light-sensitive material and the dye-fixing material of the present invention may contain a plasticizer, a slipping agent as well as a high boiling point organic solvent as an agent for improving peelability between the light-sensitive material and the dye-fixing material. Specific examples thereof are described in the above-described RDs and JP-A-62-245253.

In addition, for the above-described purposes, various silicone oils (including all silicone oils from dimethylsilicone oil to modified silicone oils formed by introducing various organic groups into dimethylsiloxane) can be used. Examples thereof include various modified silicone oils as described in the technical reference *Modified Silicone Oils* (published by Shin-Etsu Silicone Co., Ltd.), page 6–18B. Of them, especially effective is a carboxy-modified silicone (X-22-3710, trade name).

In addition, the silicone oils described in JP-A-62-215953 and JP-A-63-46449 are effective.

The heat-developable light-sensitive material and dye-fixing material can contain an anti-fading agent. Examples of the anti-fading agent includes an antioxidant, an ultraviolet absorbent, and various kinds of metal complexes. Furthermore, the dye image stabilizer and ultraviolet absorbent described in the above-described RDs may be used.

Examples of the antioxidant include chroman compounds, coumaran compounds, phenol compounds (e.g., hindered phenols), hydroquinone derivatives, hindered amine derivatives and spiroindane compounds. The compounds described in JP-A-61-159644 are also effective.

Examples of the ultraviolet absorbent include benzotriazole compounds (U.S. Pat. No. 3,533,794), 4-thiazolidone compounds (U.S. Pat. No. 3,352,681), benzophenone compounds (JP-A- 46-2784) and other compounds as described in JP-A-54-48535, JP-A-62-136641 and JP-A-61-88256. Furthermore, ultraviolet-absorbing polymers described in JP-A-62-260152 are also effective.

Examples of the metal complexes include compounds described in U.S. Pat. Nos. 4,241,155, 4,245,018 (columns 3 to 36) and U.S. Pat. No. 4,254,195 (columns 3 to 8), JP-A-62-174741, JP-A-61-88256 (pages 27 to 29), JP-A-63-199248, JP-A-1-75568 and JP-A-1-74272.

The anti-fading agent for preventing the dye as transferred to the dye-fixing material from fading may previously be incorporated into the dye-fixing material or, alternatively, it may be supplied to the dye-fixing material from an external source such as a light-sensitive material containing the agent.

The above-described antioxidant, ultraviolet absorbent and metal complex can be employed in the present invention in combination thereof.

The heat-developable light-sensitive material and the dye-fixing material can contain a brightening agent. In particular, it is preferred to incorporate a brightening agent in the dye-fixing element or to supply the same to the said element from an external source such as a light-sensitive element containing the agent. Examples of the agent include compounds as described in K. Veenkataraman, *The Chemistry of Synthetic Dyes*, Vol. V, Chap. 8, and JP-A-61-143752. Specific examples thereof include stilbene compounds, coumarin compounds, biphenyl compounds, benzoxazolyl compounds, naphthalimide compounds, pyrazoline compounds and carbostyryl compounds.

The brightening agent can be employed in combination with the anti-fading agent or the ultraviolet absorbent.

Examples of the anti-fading agent, the ultraviolet absorbent and the brightening agent are described in JP-A-62-215272, pages 125 to 137 and JP-A-1-161236, pages 17 to 43.

The layers constituting the heat-developable light-sensitive material and the dye-fixing material can contain a hardening agent. Examples thereof include hardening agents described in the above-described RDs, U.S. Pat. Nos. 4,678,739 (column 41) and U.S. Pat. No. 4,791,042 and JP-A-59-116655, JP-A-62-245261, JP-A-61-18942 and JP-A-4-218044. Specific examples include aldehyde hardening agents (e.g., formaldehyde), aziridine hardening agents, epoxy hardening agents, vinylsulfone hardening agents (e.g., N,N'-ethylenebis(vinylsulfonyl-acetamide)ethane), N-methylol hardening agents (e.g., dimethylolurea) and high polymer hardening agents (e.g., compounds described in JP-A-62-234157).

The hardening agent is preferably used in an amount of from 0.001 g to 1 g, more preferably 0.005 g to 0.5 g, per g of gelatin coated. The hardening agent may be incorporated in any of the layers constituting the light-sensitive material or dye-fixing material or may be separately incorporated in two or more layers.

The layers constituting the heat-developable light-sensitive material or dye-fixing material may comprise various fog inhibitors, photographic stabilizers, or precursors thereof. Specific examples of these compounds are described in the above cited RDs, U.S. Pat. Nos. 5,089,378, 4,500,627 and 4,614,702, JP-A-64-13546, pages 7 to 9, pages 57 to 71, pages 81 to 97, U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, and RD 17643 (1978), pages 24 to 25.

These compounds are preferably used in an amount of $5\times10^{-6}$ to $1\times10^{-1}$ mol, more preferably $1\times10^{-5}$ to $1\times10^{-2}$ mol, per mol of silver.

The layers constituting the light-sensitive material and the dye-fixing material of the present invention can contain various surfactants for various purposes of aiding coating, improvement of the peeling property, improvement of the sliding property, prevention of static charge and enhancement of developability. Specific examples of the surfactants are described in the above-described RDs, JP-A-62-173463 and JP-A-62-183457.

The layers constituting the light-sensitive material and the dye-fixing material of the present invention can contain organic fluorine compounds for improvement of the sliding property, prevention of static charge and improvement of the peeling property. Specific examples of the organic fluorine compounds include fluorine surfactants described in JP-B-57-9053 (columns 8 to 17), JP-A-61-20944 and JP-A-62-135826, and hydrophobic fluorine compounds such as fluorine oil and like oily fluorine compounds and ethylene tetrafluoride resins and like solid fluorine compound resins.

The light-sensitive material and the dye-fixing material can contain a matting agent. Examples of the matting agent include silicon dioxide and compounds described in JP-A-61-88256 (page 29) such as polyolefins or polymethacrylates, as well as compounds described in JP-A-63-274944 and JP-A-63-274952, such as benzoguanamine resin beads, polycarbonate resin beads and AS (acrylonitrile-styrene) resin beads. In addition, compounds described in the above-described RDs are used. These matting agents can be added into the uppermost layer (protective layer), and if needed, a lower layer.

In addition, the layers constituting the light-sensitive element and the dye-fixing element may further contain a thermal solvent, a defoaming agent, a microbicidal and fungicidal agent, colloidal silica and other additives. Examples of such additives are described in JP-A-61-88256 (pages 26 to 32), JP-A-3-11338 and JP-B-2-51486.

In the present invention, the heat-developable light-sensitive material and/or the dye-fixing material can contain an image formation accelerator. The image formation accelerators include those which promote a redox reaction between a silver salt oxidizing agent and a reducing agent, those which promote the reactions of forming a dye from a dye-donating substance or decomposing a dye or releasing a diffusible dye, and those which promote the migration of a dye from the heat-developable light-sensitive layer to the dye-fixing layer. According to physicochemical function, the image formation accelerators can be classified into bases or base precursors, nucleophilic compounds, high boiling point organic solvents (oils), thermal solvents, surfactants and compounds which interact with silver or silver ions, for instance. However, each of these substances generally has plural functions and provides several of the above-described effects. A detailed discussion on these substances can be found in U.S. Pat. No. 4,678,739 at columns 38 to 40.

The base precursor include salts of an organic acid which may be decarboxylated under heat and a base, and compounds capable of releasing an amine by an intramolecular nucleophilic substitution reaction, Rossen rearrangement or Beckmann rearrangement. Specific examples thereof are described in U.S. Pat. Nos. 4,514,493 and 4,657,848.

In the system where heat-development and dye transfer are effected simultaneously in the presence of a small amount of water, it is preferred to incorporate the base and/or base precursor in the dye-fixing material for improving the storage stability of the heat-developable light-sensitive material.

In addition, the combination of a hardly soluble metal compound and a compound capable of complexing with the metal ion which constitutes the hardly soluble metal compound (hereinafter referred to as a "complex-forming compound") described in EP-A-210660, U.S. Pat. No. 4,740,445; and compounds yielding a base by electrolysis described in JP-A-61-232451 can also be used as the base precursor. Use of the former is especially effective. The hardly soluble metal compound and the complex-forming compound are advantageously separately added to-different heat-developable light-sensitive material and dye-fixing material as described in the above references.

The heat-developable light-sensitive material and/or the dye-fixing material of the present invention can contain various development terminating agent for always obtaining constant images despite fluctuations in the development temperature and the processing time for development.

The terminology "development terminating agent" as used herein means a compound which, after proper development, quickly neutralizes a base or reacts with a base to lower the base concentration in the layer in which the base is present and thereby terminates the development, or a compound which interacts with silver or a silver salt to arrest development. Specific examples thereof include acid precursors which release an acid under heat, electrophilic compounds which react with the existing base by a substitution reaction under heat, as well as nitrogen-containing heterocyclic compounds, mercapto compounds and precursors thereof as described in JP-A-62-253159 (pages 31 and 32).

The support which is employed in preparing the heat-developable light-sensitive material and the dye-fixing material of the present invention may be any support that withstands the processing temperature. In general, paper and synthetic high polymer films, such as described in *Bases of Photographic Engineering*, Edition of Silver Photography, pages 223 to 240 (published by Corona Publishing Co., Ltd., Japan, 1979), are used as the support. Specifically, the support includes films of polyethylene terephthalate (PET), polycarbonates, polyvinyl chloride, polystyrene, polypropylene, polyimide, celluloses (e.g., triacetyl cellulose) and those films containing a pigment such as titanium oxide; synthetic paper made of polypropylene by a filming method; mixed paper made of a synthetic resin pulp (e.g., polyethylene) and a natural pulp; Yankee paper; baryta paper; coated paper (especially cast-coated paper); metals; cloth; and glass.

These supports may be used directly alone or may be used in the form as coated with a synthetic high polymer substance (e.g., polyethylene) on one surface or both surfaces thereof. The coated layer may contain pigments or dye such as titanium oxide, ultramarine and carbon black, if necessary.

In addition, supports described in JP-A-62-253159, pages 29 to 31, JP-A-1-161236, pages 14 to 17, JP-A-63-316848, JP-A-2-22651, JP-A-3-56955 and U.S. Pat. No. 5,001,033 can also be employed in the present invention.

The surface of the support may be coated with a hydrophilic binder and a semiconductive metal oxide (e.g., alumina sol or tin oxide) or an antistatic agent such as carbon black. Specifically, supports described in JP-A-62-220246 can also be used.

The surface of the support is preferably subjected to various surface treatment or coating treatment in order to improve adhesivity to a hydrophilic binder.

For imagewise exposing and recording an image on the heat-developable light-sensitive material of the present invention, various methods can be employed, which include, for example, a method for directly photographing a scene or man with a camera; a method for exposing an image through a reversal film or negative film by the use of a printer or an enlarger; a method for scanning and exposing an original through a slit by the use of an exposing device of a duplicator; a method for exposing image information via a corresponding electric signal by emitting the same with an emitting diode or various lasers (e.g., laser diode, gas laser) as-described in JP-A-2-129625, JP-A-5-176144, JP-A-5-199372 and JP-A-6-127021; and a method for outputting image information with an image display device such as a CRT, liquid crystal display, electroluminescence display or plasma display and then exposing the same directly or via some optical system.

As the light source used for recording an image on the light-sensitive material of the present invention, those as described in U.S. Pat. No. 4,500,626 (column 56), JP-A-2-53378 and JP-A-2-54672, such as natural light, a tungsten lamp, a light-emitting diode, laser rays and CRT rays can be employed as mentioned above.

Furthermore, a wavelength conversion element in which a nonlinear optical material is combined with a coherent light source such as laser can be used to effect imagewise exposure. The nonlinear optical material is a material capable of developing nonlinearity between polarization and electric field created when a strong photoelectric field such as laser light is given. Inorganic compounds such as lithium niobate, potassium dihydrogenphosphate (KDP), lithium iodate and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62- 210432. As wavelength conversion elements, single crystal light guide type wavelength conversion element and fiber type wavelength conversion element have been known. Any of these types of wavelength conversion elements can be effectively used.

As the above-described image information, any image signals obtained from a video camera or electronic still camera; television signals as standardized by the Nippon Television Signal Code (NTSC); image signals obtained by dividing an original into plural pixels with a scanner; and image signals formed by the use of a computer such as CG or CAD, can be employed.

The heat-developable light-sensitive material and/or dye-fixing material according to the present invention may have an electrically conductive heating element layer as a heating means for heat development and diffusion transfer of dye. In this embodiment, heating elements described in JP-A-61-145544 may be used.

The heating temperature in the heat-development step of the present invention is from about 50° C. to about 250° C., preferably from about 60° C. to about 180° C. The step of diffusing and transferring the dye formed by development may be effected simultaneously with the heat-development step or after the same. In the latter case, the heating temperature in the transfer step may be from the temperature in the previous heat-development step to room temperature. Preferably, it is from 50° C. to a temperature lower than the temperature in the heat-development step by about 10° C.

Migration of the dye formed may be effected only by heat, but a solvent may be used for accelerating the migration of the dye. Furthermore, as described in detail in U.S. Pat. Nos. 4,704,345 and 4,740,445 and JP-A-61-238056, a method in which development and transfer are carried out in the presence of a small amount of a solvent (especially, water) under heating, either at the same time or in a continuous sequence, can be advantageously utilized. In this method, the heating temperature is preferably from 50° C. to the boiling point of the solvent used. For instance, when the solvent is water, the temperature is desirably from 50° C. to 100° C.

Examples of the solvents used for the acceleration of development and/or transfer of the diffusible dye include water, an aqueous basic solution containing an inorganic alkali metal salt or an organic base, a low boiling point solvent or a mixed solvent comprising a low boiling point solvent and water or an aqueous basic solution. Furthermore, surfactants, antifoggants, complex-forming compounds with hardly soluble metals, an antiputrefaction agent, and an antimicrobial agent can be incorporated into the solvents.

As the solvent used in these heat-developing and diffusion-transferring steps, water is preferred. As water, any ordinary water may be employed. For example, concretely mentioned are distilled water, city tap water, well water, and mineral water. In the heat-developing device to be used for processing the hear-developable material of the present invention along with dye-fixing material, water once used may be drained off or may be circulated through the device for recycle use. In the latter case, water to be circulated and re-used contains chemicals dissolved out from the processed materials. In addition, devices and water described in JP-A-63-144354, JP-A-63-144355, JP-A-62-38460, and JP-A-3-210555 can also be used in processing the light-sensitive materials of the present invention.

The solvent can be applied to either or both of the heat-developable light-sensitive material and the dye-fixing material. The amount of the solvent to be applied may be equal to or less than the weight of the solvent corresponding to the maximum swollen volume of all the coated layers.

Preferable methods for applying water to the material include methods described in JP-A-62-253159, page 5 and JP-A-63-85544. The solvent to be applied may be encapsulated in microcapsules or may be incorporated into the heat-developable light-sensitive material and/or the dye-fixing material as its hydrate.

The temperature of water to be applied is from 30° C. to 60° C., as described in the above-described JP-A-63-85544. In particular, the temperature is preferably 45° C. or higher in order to present harmful microbes from growing in water.

In order to accelerate the migration of the dye formed, a system of incorporating a hydrophilic thermal solvent which is solid at room temperature but which can melt at a high temperature into the light-sensitive material or into the dye-fixing material may also be employed in the present invention. In employing this system, the hydrophilic thermal solvent may be incorporated into either the light-sensitive material or the dye-fixing material or into both of them. The layer to which the solvent is added may be any of the light-sensitive silver halide emulsion layer, interlayer, protective layer and dye-fixing layer, but the solvent is preferably added to the dye-fixing layer and/or layer(s) adjacent thereto.

Examples of the thermal solvent to be employed in such a system include ureides, pyridines, amides, sulfon-amides, imides, alcohols, oximes and other heterocyclic compounds.

For heating the materials in the development step and/or the transfer step, they may be kept in contact with a heated block or plate, or with a hot plate, hot presser, hot roller, halogen lamp heater or infrared or far-infrared lamp heater or may be passed through a high temperature atmosphere.

When the light-sensitive material is attached to the dye-fixing material, methods described in JP-A-62-253159 and JP-A-61-147244 (page 27) are applicable.

For processing the photographic elements of the present invention, any general heat-developing apparatus can be utilized. For instance, apparatus described in JP-A-59-75247, JP-A-59-177547, JP-A-59-181353 and JP-A-60-18951, JU-A-62-25944 are preferably employed (the term "JU-A" as used herein means an "examined Japanese utility application"). Examples of commercially available heat developing apparatus include Pictrostat 100, Pictrostat 200, Pictrography 2000 and Pictrography 3000 produced by Fuji Photo Film Co., Ltd.

The present invention will be described below in greater detail with reference to the Examples; however, the present invention should not be construed as being limited thereto.

EXAMPLE 1

Preparation of Light-Sensitive Silver Halide Emulsion:

Light-Sensitive Silver Halide Emulsion (1) (for red-sensitive emulsion layer):

To a well stirred aqueous gelatin solution (obtained by adding 800 g of gelatin, 12 g of potassium bromide, 80 g of sodium chloride and 1.2 g of Compound (a) into 27 l of water and kept at 55° C.), Solution (I) and Solution (II) shown in Table 1 were added simultaneously at the same flow rate over 19 minutes. After 5 minutes, Solution (III) and Solution (IV) shown in Table 1 were further added simultaneously at the same flow rate over 24 minutes.

The mixture was washed with water and desalted (conducted using precipitant (a) at a pH of 4.02) according to a usual method, 880 g of a lime-processed ossein gelatin and 2.8 g of Compound (b) were added, the pH and the pAg were adjusted to 6.0 and 7.7, respectively, optimal chemical sensitization was conducted at 60° C. for about 70 minutes by adding 20.5 g of a ribonucleic acid decomposition product and 51 mg of trimethylthiourea, and after adding 9.0 g of 4-hydroxy-6-methyl-1,3,3a,7-tetrazaindene, 3.2 g of Dye (a), 20.5 g of KBr and 5.1 g of a stabilizer shown later in sequence, the mixture was cooled. As a result, 29.5 kg of a monodispersed cubic silver chlorobromide emulsion having an average grain size of 0.30 μm was obtained.

TABLE 1

| | Solution (I) | Solution (II) | Solution (III) | Solution (IV) |
|---|---|---|---|---|
| $AgNO_3$ | 1,200 g | — | 2,800 g | — |
| $NH_4NO_3$ | 2.5 g | — | 2.5 g | — |
| KBr | — | 546 g | — | 1,766 g |
| NaCl | — | 144 g | — | 96 g |
| $K_2IrCl_6$ | — | 3.6 mg | — — | |
| | Water to make 6.5 l | Water to make 6.5 l | Water to make 10 l | Water to make 10 l |

Compound (a)

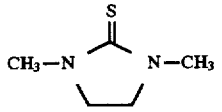

TABLE 1-continued

| | Solution (I) | Solution (II) | Solution (III) | Solution (IV) |
|---|---|---|---|---|

Compound (b)

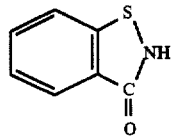

Dye (a)

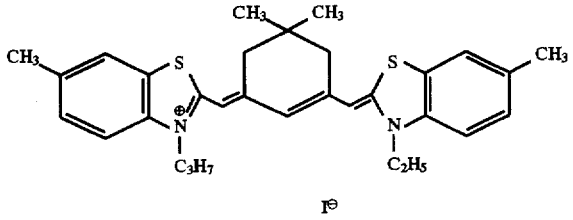

Light-Sensitive Silver Halide Emulsion (2) (for green-sensitive emulsion layer):

To a well stirred aqueous gelatin solution (obtained by adding 20 g of gelatin, 0.3 g of potassium bromide, 2 g of sodium chloride and 3 mg of Compound (a) into 600 ml of water and kept at 46° C.), Solution (I) and Solution (II) shown in Table 2 were added simultaneously at the same flow rate over 9 minutes. After 5 minutes, Solution (III) and Solution (IV) shown in Table 2 were added simultaneously at the same flow rate over 32 minutes. One minute after completion of the addition of Solutions (III) and (IV), 60 ml of a methanol solution of dyes (containing 360 mg of Dye (b1) and 73.4 mg of Dye (b2)) was collectively added.

The mixture was washed with water and desalted (conducted using precipitant (a) at a pH of 4.0) according to a usual method, 22 g of a lime-processed ossein gelatin was added, the pH and the pAg were adjusted to 6.0 and 7.6, respectively, by adding NaCl and NaOH each in an appropriate amount, optimal chemical sensitization was conducted by adding 1.8 mg of sodium thiosulfate and 180 mg of 4-hydroxy-6-methyl-1,3,3a,7-tetrazaindene, and after adding 90 mg of Antifoggant (1), the mixture was cooled. Furthermore, 70 mg of Compound (b) and 3 ml of Compound (c) were added as antiseptics. As a result, 635 g of a monodispersed cubic silver chlorobromide emulsion having an average grain size of 0.30 μm was obtained.

TABLE 2

| | Solution (I) | Solution (II) | Solution (III) | Solution (IV) |
|---|---|---|---|---|
| $AgNO_3$ | 10.0 g | — | 90.0 g | — |
| $NH_4NO_3$ | 0.06 g | — | 0.38 g | — |
| KBr | — | 3.50 g | — | 57.1 g |
| NaCl | — | 1.72 g | — | 3.13 g |
| $K_2IrCl_6$ | — | — | — | 0.03 mg |
| | Water to make 126 ml | Water to make 131 ml | Water to make 280 ml | Water to make 289 ml |

Dye (b1)

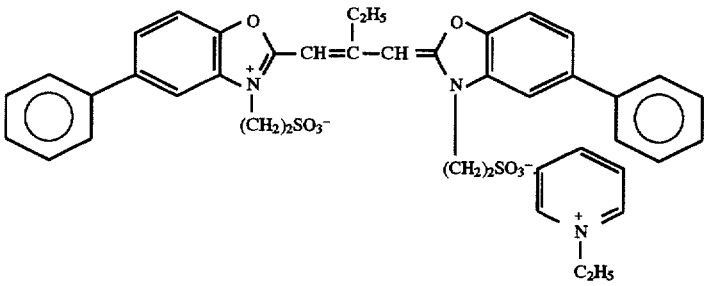

Dye (b2)

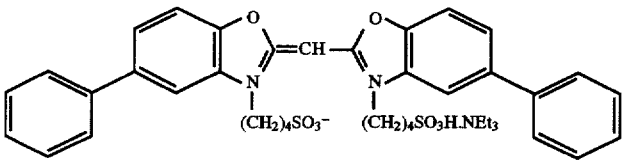

Precipitant (a)

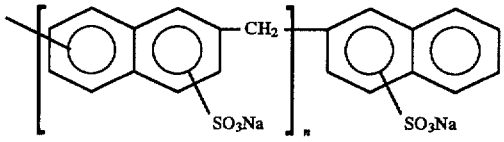

Antifoggant (1)

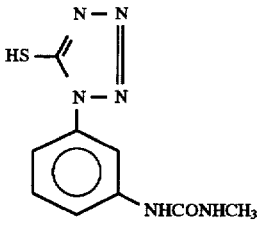

Compound (c)

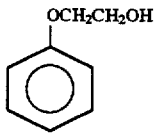

Silver Halide Fine Grain Emulsion (B-1):

To a well stirred aqueous gelatin solution (obtained by adding 58 g of gelatin, 34.5 g of KBr and 12.88 g of KI into 8.37 l of water and kept at 35° C.), Solution I and Solution II shown in Table 3 were added simultaneously at an accelerated flow rate (the flow rate at the final was 3 times the flow rate at the initiation) over 5 minutes. Five minutes after completion of the addition of Solution I, an aqueous gelatin solution (obtained by adding 116 g of gelatin into 0.75 l of water and kept at 40° C.) was added.

Thereafter, the mixture was washed with water and desalted (conducted using 6.36 g of Precipitant (b) at a pH of 3.8), the pH was adjusted to 6.7 by adding 60 g of a lime-processed ossein gelatin and 0.4 g of Compound (b), and then the mixture was cooled. In the thus-obtained emulsion, the silver halide grains were spherical and the grain size was 0.03 μm. The yield was 4.19 kg.

TABLE 3

| | Solution (I) | Solution (II) |
|---|---|---|
| $AgNO_3$ | 230 g | — |
| KI | — | 224.3 g |
| KBr | — | — |
| | Water to make 460 ml | Water to make 1,121 ml |
| | Precipitant (b) | |

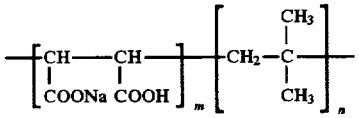

m + n = 1

Light-Sensitive Silver Halide Emulsion (3) (for blue-sensitive emulsion layer):

To a well stirred aqueous gelatin solution (obtained by adding 1.582 g of gelatin, 127 g of KBr and 660 mg of Compound (a) into 29.2 l of water and kept at 72° C.), Solutions I and II each having the composition shown in Table 4 were added such that Solution II was first added and 10 seconds after, Solution I shown in Table 4 was added, each over 30 minutes. Two minutes after completion of -the addition of Solution I, Solution V was added, 5 minutes after completion of the addition of Solution II, Solution IV was added, and 10 seconds after then, Solution III was added. Solution III was added over 27 minutes and 50 seconds and Solution IV was added over 28 minutes.

Thereafter, the mixture was washed with water and desalted (conducted using 32.4 g of Precipitant (b) at a pH of 3.9), the pH and the pAg were adjusted to 6.1 and 8.5 by adding 1.230 g of a lime-processed ossein gelatin and 2.8 g of Compound (b), optimal chemical sensitization was conducted at 65° C. for about 70 minutes by adding 24.9 mg of sodium thiosulfate, and after adding 13.1 g of Dye (c) and 118 ml of Compound (c) in sequence, the mixture was cooled. In the thus-obtained emulsion, the silver halide grains were a potato-like grain, the grain size was 0.53 μm, silver iodide was contained in the inside of grain and the average silver iodide content was about 0.5 mol %. The yield was 30.7 kg.

TABLE 4

| | Solution (I) | Solution (II) | Solution (III) | Solution (IV) | Solution (V) |
|---|---|---|---|---|---|
| $AgNO_3$ | 939 g | — | 3,461 g | — | — |
| $NH_4NO_3$ | 3.4 g | — | 15.4 g | — | — |
| KBr | — | 572 g | — | 2,464 g | — |
| KI | — | — | — | — | 22.0 g |
| | Water to make 6.69 l | Water to make 6.68 l | Water to make 9.70 l | water to make 9.74 l | Water to make 4.40 l |

Dye (c)

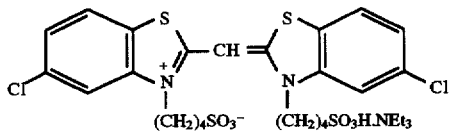

Light-Sensitive Silver Halide Emulsion (4) (for blue-sensitive emulsion layer):

Light-Sensitive Silver Halide Emulsion (4) was prepared in the same manner as Light-Sensitive Silver Halide Emulsion (3), except for omitting the addition of Solution V.

Light-Sensitive Silver Halide Emulsion (5) (for blue-sensitive emulsion layer):

Light-Sensitive Silver Halide Emulsion (5) was prepared in the same manner as Light-Sensitive Silver Halide Emulsion (3), except for adding 411 g of Silver Halide Fine Grain Emulsion (B-1) (kept at 40° C. and added at a constant flow rate over 1 minute) in place of Solution V.

Light-Sensitive Silver Halide Emulsion (5) comprised silver halide grains which were a potato-like grain, had a grain size of 0.53 μm, contained silver iodide in the inside of grain and had an average silver iodide content of about 0.5 mol %.

Light-Sensitive Silver Halide Emulsion (6) (for blue-sensitive emulsion layer):

Light-Sensitive Silver Halide Emulsion (6) was prepared in the same manner as Light-Sensitive Silver Halide Emulsion (3), except for adding 6.9 mg of Compound I-1 described in the specification 10 minutes before the addition of sodium thiosulfate.

Light-Sensitive Silver Halide Emulsion (7) (for blue-sensitive emulsion layer):

Light-Sensitive Silver Halide Emulsion (7) was prepared in the same manner as Light-Sensitive Silver Halide Emulsion (4), except for adding 6.9 mg of Compound I-1 described in the specification 10 minutes before the addition of sodium thiosulfate.

Light-Sensitive Silver Halide Emulsion (8) (for blue-sensitive emulsion layer):

Light-Sensitive Silver Halide Emulsion (8) was prepared in the same manner as Light-Sensitive Silver Halide Emulsion (5), except for adding 6.9 mg of Compound I-1 described in the specification 10 minutes before the addition of sodium thiosulfate.

The preparation of the gelatin dispersion of Compound (d) is described below.

Compound (d), High Boiling Point Organic Solvent (1), Compound (f), Compound (g), Compound (h) and Surface Active Agent (1) were weighed to 0.4 g, 1.2 g, 0.12 g, 0.25 g, 0.05 g and 0.2 g, respectively, and 9.5 ml of ethyl acetate was added thereto and dissolved under heating at about 60° C. to obtain a uniform solution. The resulting solution and 29.1 g of a 18% solution of a lime-processed gelatin were mixed while stirring and dispersed in a homogenizer for 10 minutes at 10,000 rpm. After the dispersion, 18.5 ml of water for dilution was added. The dispersion solution obtained was designated as the dispersion of Compound (d).

Compound (d):

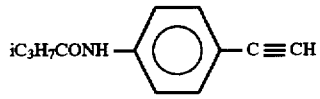

High Boiling Point Organic Solvent (1):

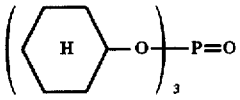

-continued

Compound (f)

$C_{26}H_{46.9}Cl_{7.1}$

Compound (g)

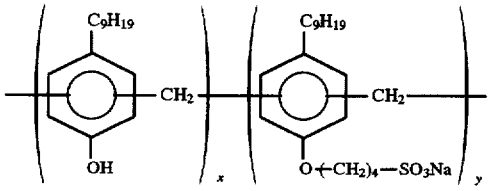

x/y = 58/42

Surface Active Agent (1)

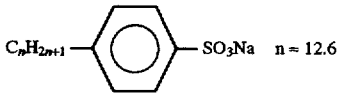

-continued

Compound (h)

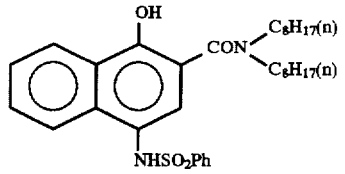

The preparation method of the dispersion of zinc hydroxide is described below.

To 100 ml of a 4% aqueous gelatin solution, 12.5 g of zinc hydroxide having an average particle size of 0.2 μm, 1 g of carboxymethyl cellulose as a dispersant and 0.1 g of sodium polyacrylate were added, and the mixture was crushed in a mill using glass beads having an average particle size of 0.75 mm for 30 minutes. The glass beads were separated and a dispersion of zinc hydroxide was obtained.

The preparation of a gelatin dispersion of the dye-donating compound is described below.

Cyan Dye-Donating Compound (A1), Cyan Dye-Donating Compound (A2), Surface Active Agent (1), Compound (h), Compound (i), High Boiling Point Organic Solvent (1) and High Boiling Point Organic Solvent (2) were weighed to 7.3 g, 11.0 g, 0.8 g, 1 g, 2.2 g, 7 g and 3 g, respectively, and 26 ml of ethyl acetate and 1.2 ml of were added thereto and dissolved under heating at about 60° C. to obtain a uniform solution. The resulting solution, 65 g of a 16% solution of a lime-processed gelatin and 87 ml of water were mixed while stirring and dispersed in a homogenizer for 10 minutes at 10,000 rpm. After the dispersion, 216 ml of water for dilution were added. The resulting dispersion solution was designated as the dispersion of a cyan dye-donating compound.

Cyan Dye-Donating Compound (A1)

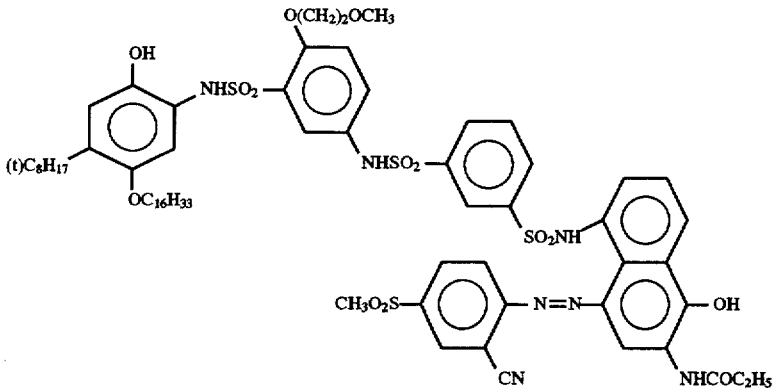

-continued

Cyan Dye-Donating Compound (A2)

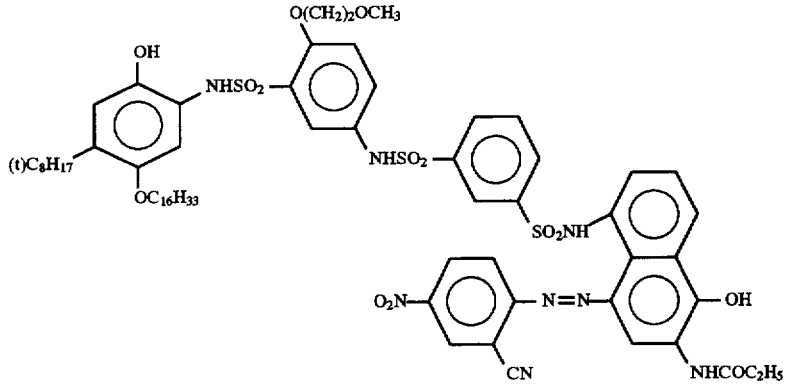

Compound (h)

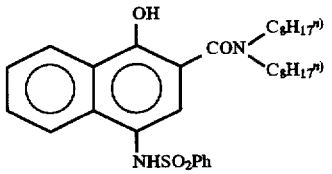

Compound (i)

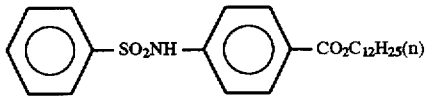

High Boiling Point Solvent (2)

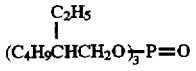

Magenta Dye-Donating Compound (B), Compound (m), Compound (h), Surface Active Agent (1) and High Boiling Point Organic Solvent (2) were weighed to 4.50 g, 0.05 g, 0.05 g, 0.094 g and 2.25 g, respectively, and 10 ml of ethyl acetate was added thereto and dissolved under heating at about 60° C. to obtain a uniform solution. The resulting solution, 15.2 g of a 16% solution of a lime-processed gelatin and 23.5 ml of water were mixed while stirring and dispersed in a homogenizer for 10 minutes at 10,000 rpm. Thereafter, 42 ml of water for dilution was added. The resulting dispersion solution was designated as the dispersion of a magenta dye-providing compound.

Magenta Dye-Donating Compound (B)

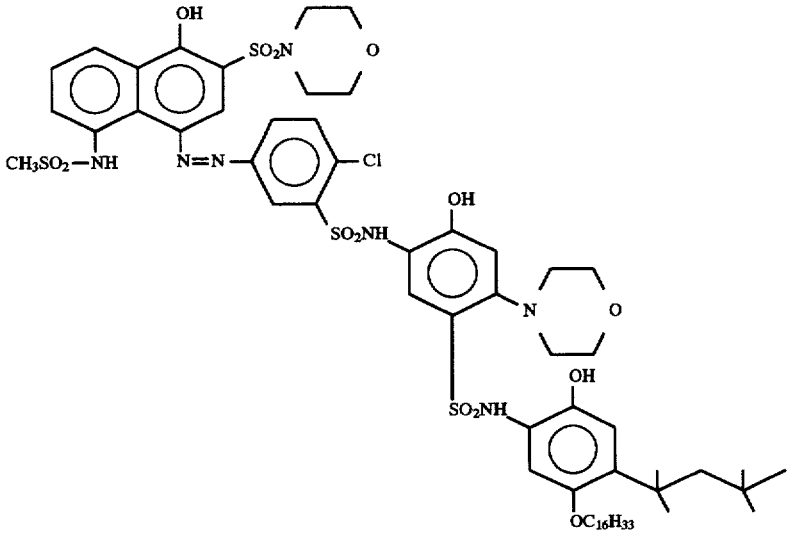

-continued

Compound (m)

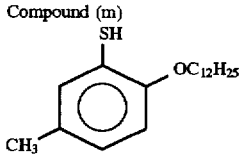

Yellow Dye-Donating Compound (C), Compound (d), Compound (h), Surface Active Agent (1), Compound (j), Compound (k) and High Boiling Point Organic Solvent (1) were weighed to 15 g, 2.3 g, 0.9 g, 0.88 g, 3.9 g, 1.9 g and 16.9 g, respectively, and 49 ml of ethyl acetate was added thereto and dissolved under heating at about 60° C. to obtain a uniform solution. The resulting solution, 63.5 g of a 16% solution of a lime-processed gelatin and 103 ml of water were mixed while stirring and dispersed in a homogenizer for 10 minutes at 10,000 rpm. Thereafter, 94 ml of water for dilution was added. The resulting dispersion solution was designated as the dispersion of a yellow dye-donating compound.

Yellow Dye-Donating Compound (C)

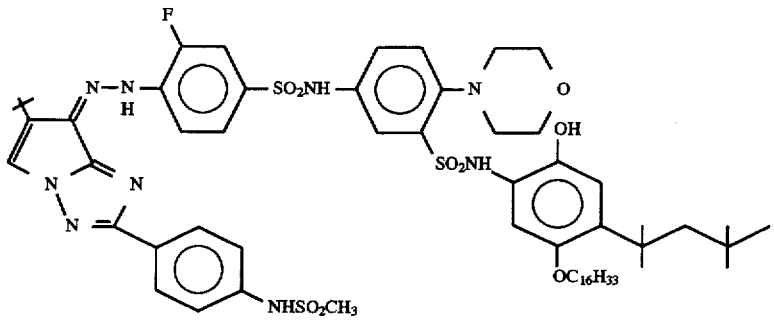

Compound (j)

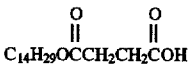

Compound (k)

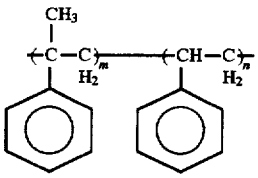

Using these, Heat-Developable Light-Sensitive Material 101 was prepared to have a structure shown in Table 5.

TABLE 5

Structure of Light-Sensitive Material (Light-Sensitive Material 101)

| Layer No. | Name of Layer | Additives | Coated Amount ($g/m^2$) |
|---|---|---|---|
| Seventh Layer | Protective Layer | Acid-processed gelatin | 0.564 |
| | | PMMA Matting agent | 0.025 |
| | | Surface Active Agent (2) | 0.008 |
| | | Surface Active Agent (3) | 0.024 |
| Sixth Layer | Interlayer | Gelatin | 0.538 |
| | | $Zn(OH)_2$ | 0.403 |
| | | Surface Active Agent (3) | 0.0011 |
| | | Compound (d) | 0.024 |

TABLE 5-continued

| | | | |
|---|---|---|---|
| | | Compound (f) | 0.007 |
| | | Compound (g) | 0.015 |
| | | Compound (h) | 0.003 |
| | | High Boiling Point Organic Solvent (1) | 0.072 |
| | | $Ca(NO_3)_2$ | 0.008 |
| | | Surface Active Agent (1) | 0.013 |
| | | Water-Soluble Polymer (1) | 0.004 |
| Fifth Layer | Blue-sensitive Layer | Silver Halide Emulsion (3) | 0.414 in terms of silver |
| | | Gelatin | 0.437 |

TABLE 5-continued

| | | | |
|---|---|---|---|
| | | Yellow Dye-Donating Compound (C) | 0.329 |
| | | Compound (d) | 0.051 |
| | | Compound (h) | 0.020 |
| | | Compound (j) | 0.086 |
| | | Compound (k) | 0.042 |
| | | High Boiling Point Organic Solvent (1) | 0.370 |
| | | Surface Active Agent (1) | 0.019 |
| | | Water-Soluble Polymer (1) | 0.005 |
| Fourth Layer | Interlayer | Gelatin | 0.461 |
| | | $Zn(OH)_2$ | 0.345 |
| | | Surface Active Agent (3) | 0.0009 |
| | | Compound (d) | 0.021 |
| | | Compound (f) | 0.006 |
| | | Compound (g) | 0.013 |
| | | Compound (h) | 0.0026 |
| | | High Boiling Point Organic Solvent (1) | 0.062 |
| | | $Ca(NO_3)_2$ | 0.007 |

TABLE 5-continued

| | | | |
|---|---|---|---|
| | | Surface Active Agent (1) | 0.011 |
| | | Water-Soluble Polymer (1) | 0.003 |
| Third Layer | Green-Sensitive Layer | Silver Halide Emulsion (2) | 0.414 in terms of silver |
| | | Gelatin | 0.450 |
| | | Magenta Dye-Donating Compound (B) | 0.450 |
| | | Compound (m) | 0.005 |
| | | Compound (h) | 0.005 |
| | | High Boiling Point Organic Solvent (2) | 0.225 |
| | | Surface Active Agent (1) | 0.010 |
| | | Water-Soluble Polymer (1) | 0.013 |
| Second Layer | Interlayer | Gelatin | 0.439 |
| | | Surface Active Agent (4) | 0.132 |
| | | Surface Active Agent (3) | 0.006 |
| | | Compound (d) | 0.022 |
| | | Compound (f) | 0.007 |
| | | Compound (g) | 0.014 |
| | | Compound (h) | 0.003 |
| | | High Boiling Point Organic Solvent (1) | 0.065 |
| | | $Ca(NO_3)_2$ | 0.008 |
| | | Water-Soluble Polymer (1) | 0.008 |
| First Layer | Red-Sensitive Layer | Silver Halide Emulsion (1) | 0.191 in terms of silver |
| | | Gelatin | 0.278 |
| | | Cyan Dye-Donating Compound (A1) | 0.121 |
| | | Cyan Dye-Donating Compound (A2) | 0.182 |
| | | Compound (i) | 0.036 |
| | | Compound (h) | 0.017 |
| | | High Boiling Point Organic Solvent (2) | 0.051 |
| | | High Boiling Point Organic Solvent (1) | 0.119 |
| | | Surface Active Agent (1) | 0.013 |
| | | Water-Soluble Polymer (1) | 0.012 |
| | | Stabilizer | 0.004 |
| | | Hardening Agent (1) | 0.053 |
| Support (1) | Polyethylene-laminated paper support (thickness: 131 μm) | | |

Support (1):

| Name of Layer | Composition | | Layer Thickness (μm) |
|---|---|---|---|
| Surface Undercoat Layer | Gelatin | | 0.1 |
| Surface PE Layer (glossy) | Low-density polyethylene (density: 0.923): | 89.2 parts | 36.0 |
| | Surface-treated titanium oxide: | 10.0 parts | |
| | Ultramarine: | 0.8 part | |
| Pulp Layer | Wood free paper (LBKP/NBKP = 1/1, density: 1.080) | | 64.0 |
| Back PE Layer (mat) | High-density polyethylene (density: 0.960) | | 31.0 |
| Back Undercoat Layer | Gelatin | | 0.05 |
| | Colloidal Silica | | 0.05 |
| | | Total | 131.2 |

Surface Active Agent (2):

$C_8F_{17}SO_2N(C_3H_7)CH_2CH_2O(CH_2CH_2O)_nH$ n = 15

Surface Active Agent (3):

Aerosol OT

Surface Active Agent (4):

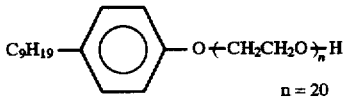

n = 20

TABLE 5-continued

Water-Soluble Polymer (1):

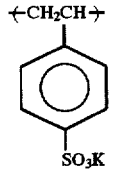

Hardening Agent (1):

$CH_2=CHSO_2CH_2SO_2CH=CH_2$

Stabilizer:

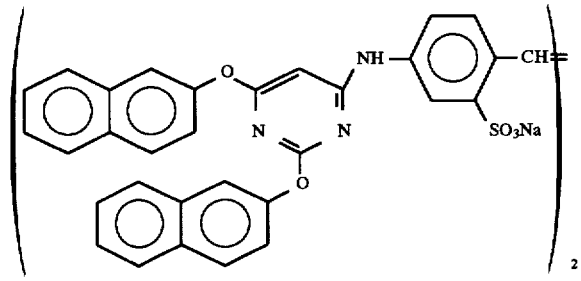

The preparation of an image-receiving material is described below.

Image-Receiving Material R201 having a structure as shown in Table 6 was prepared.

TABLE 6

Structure of Image-Receiving Material R201

| Number of Layer | Additives | Coating Amount (mg/m²) |
|---|---|---|
| Six Layer | Water-Soluble Polymer (5) | 130 |
| | Water-Soluble Polymer (2) | 35 |
| | Water-Soluble Polymer (3) | 45 |
| | Potassium nitrate | 20 |
| | Anionic Surface Active Agent (1) | 6 |
| | Anionic Surface Active Agent (2) | 6 |
| | Amphoteric Surface Active Agent (1) | 50 |
| | Stain Inhibitor (1) | 7 |
| | Stain Inhibitor (2) | 12 |
| | Matting Agent (1) | 7 |
| Fifth Layer | Gelatin | 250 |
| | Water-Soluble Polymer (5) | 25 |
| | Anionic Surface Active Agent (3) | 9 |
| | Hardening Agent (2) | 185 |
| Fourth Layer | Mordant (1) | 1,850 |
| | Water-Soluble Polymer (2) | 260 |
| | Water-Soluble Polymer (4) | 1,400 |
| | Latex Dispersion (1) | 600 |
| | Anionic Surface Active Agent (3) | 25 |
| | Nonionic Surface Active Agent (1) | 18 |
| | Guanidine picolinate | 2,550 |
| | Sodium quinolinate | 350 |
| Third Layer | Gelatin | 370 |
| | Mordant (1) | 300 |
| | Anionic Surface Active Agent (3) | 12 |
| Second Layer | Gelatin | 700 |
| | Mordant (1) | 290 |
| | Water-Soluble Polymer (5) | 55 |
| | Water-Soluble Polymer (2) | 330 |
| | Anionic Surface Active Agent (3) | 30 |
| | Anionic Surface Active Agent (4) | 7 |
| | High Boiling Point Solvent (3) | 700 |
| | Fluorescent Brightening Agent (1) | 30 |
| | Stain Inhibitor (3) | 32 |
| | Guanidine picolinate | 360 |
| | Potassium quinolinate | 45 |

TABLE 6-continued

| | | |
|---|---|---|
| First Layer | Gelatin | 280 |
| | Water-Soluble Polymer (5) | 12 |
| | Anionic Surface Active Agent (1) | 14 |
| | Sodium metaborate | 35 |
| | Hardening Agent (2) | 185 |
| Support | Polyethylene-laminated paper support (thickness: 215 μm) | |
| | The coating amount of the latex dispersion is the coating amount of solid contents. | |

Construction of Support (2)

| Name of Layer | Composition | Layer Thickness (μm) |
|---|---|---|
| Surface Undercoat Layer | Gelatin | 0.1 |
| Surface PE Layer (glossy) | Low-density polyethylene (density: 0.923): | 36.0 |
| | Surface-treated titanium oxide: | 90.2 parts |
| | Ultramarine: | 9.8 parts |
| | | 0.001 part |
| Pulp Layer | Wood free paper (LBKP/NBSP = 6/4, density: 1.053) | 152.0 |
| Back PE Layer (mat) | High-density polyethylene (density: 0.955) | 27.0 |
| Back Undercoat Layer | Styrene/acrylate copolymer | 0.1 |
| | Colloidal Silica | |
| | Sodium polystyrenesulfonate | |
| | Total | 215.2 |

Anionic Surface Active Agent (1):

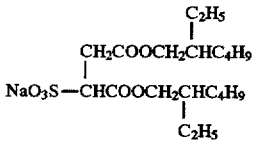

Anionic Surface Active Agent (2):

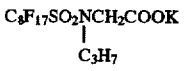

Anionic Surface Active Agent (3):

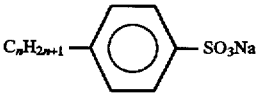

n ≈ 12.6

Anionic Surface Active Agent (4):

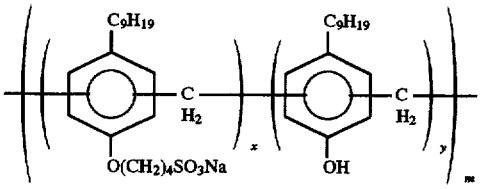

x:y = 4:6
m ≈ 6.8

TABLE 6-continued

Nonionic Surface Active Agent (1):

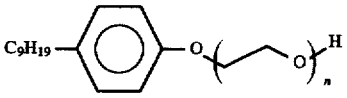

Amphoteric Surface Active Agent (1):

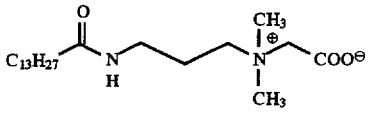

Fluorescent Brightening Agent (1):

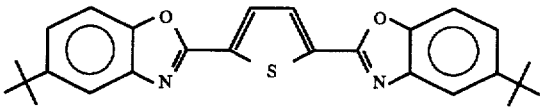

Mordant (1):

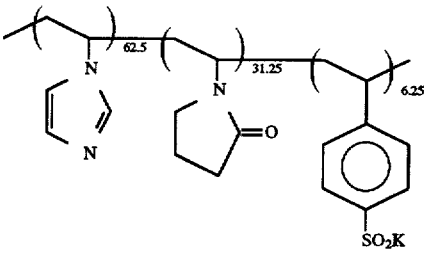

Stain Inhibitor (1):

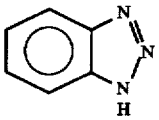

Stain Inhibitor (2):

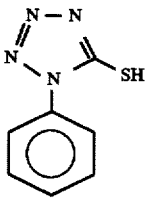

Stain Inhibitor (3):

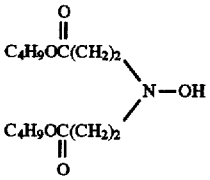

High-Boiling Point Organic Solvent (3):
$C_{26}H_{46.9}Cl_{7.1}$
Empara40 (produced by Ajinomoto Co., Ltd.)
Water-Soluble Polymer (5):

TABLE 6-continued

Sumikagel L5-H (produced by Sumitomo Chemical Co., Ltd.)
Water-Soluble Polymer (2):
Dextran (molecular weight: 70,000)
Water-Soluble Polymer (3):
κ-Carrageenan (produced by Taito Co., Ltd.)
Water-Soluble Polymer (4):
MP Polymer MP-102 (produced by Kuraray Co., Ltd.)
Latex Dispersion (1):
LX-438 (produced by Nippon Zeon Co., Ltd.)
Matting Agent (1):
SYLOID79 (produced by Fuji Devison Co., Ltd.)
Hardening Agent (2):

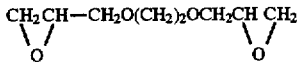

Preparation of Light-Sensitive Material 102:

Light-Sensitive Material 102 was prepared in the same manner as Light-Sensitive Material 101, except for using Silver Halide Emulsion (4) in place of Silver Halide Emulsion (3) of the blue-sensitive layer. Light-Sensitive Materials 103 to 106 were prepared in the same manner using a silver halide emulsion as shown in Table 7 below.

TABLE 7

| Light-Sensitive Material | Silver Halide Emulsion of Blue-Sensitive Layer |
|---|---|
| 101 (Comparison) | (3) |
| 102 (Comparison) | (4) |
| 103 (Comparison) | (5) |
| 104 (Invention) | (6) |
| 105 (Comparison) | (7) |
| 106 (Invention) | (8) |

Each of Light-Sensitive Materials 101 to 106 was subjected to the following exposure and processing.

Each material was exposed to a tungsten light through a B.G.R three-color separation filter (constituted by band-pass filters of R at from 600 to 700 nm, G at from 500 to 590 nm and B at from 400 to 490 nm) with the density being continuously varied, at 2,500 lux for 1/10".

Onto the emulsion surface of each exposed light-sensitive material, damping water was fed by a wire bar and then, the material was superposed on Image-Receiving Material 201 so that the layer surfaces came into contact with each other. After heating the members at a heat development temperature of 83° C. for 30 seconds, the image-receiving material was peeled off from the light-sensitive material and as a result, an image was obtained on the image-receiving material.

The image obtained was measured on the fog by conducting sensitometry using a self-recording type densitometer. The yellow fog at the development temperature of 83° C. of each light-sensitive material was as shown in Table 8 below.

Separately, the light-sensitive materials before exposure each was scratched by a needle having a diameter of 0.5 mm under a load of 100 g at a linear velocity of 10 mm/sec, and then exposed and processed in the same manner as described above. The generation of scratch streaks on the image-receiving material was visually determined on the unexposed area and the area having a gray density of 0.7. When streaks were generated, the evaluation was "poor", and no generation of streaks was evaluated "good". The results obtained are shown in Table 8.

TABLE 8

| Light-Sensitive Material | Fog/Yellow | Generation of Scratch Streaks: Unexposed Area | Generation of Scratch Streaks: Gray (0.7) |
|---|---|---|---|
| 101 (Comparison) | 0.100 | good | good |
| 102 (Comparison) | 0.105 | poor | poor |
| 103 (Comparison) | 0.100 | good | good |
| 104 (Invention) | 0.090 | good | good |
| 105 (Comparison) | 0.103 | poor | poor |
| 106 (Invention) | 0.091 | good | good |

Note:
Generated: poor
Not generated: good

The results in Table 8 show that the light-sensitive materials of the present invention are excellent in pressure property and low in the fogging upon heat development.

The light-sensitive material and the image-receiving material of the present invention each was processed into a roll and set in Fujix Pictrostat 330 sold by Fuji Photo Film Co., Ltd. in Japan since December, 1994. Furthermore, a processed negative of Fuji Color Super G400 Ace was set in a slide enlarging unit (NSE330). They were then processed and all of the processing conditions including the development time, water coating condition, transportation condition and exposure control followed the standard conditions of Fujix Pictrostat 330.

All light-sensitive materials succeeded in obtaining a printed image from the negative; however, the light-sensitive materials of the present invention could provide an image of higher quality.

Furthermore, the light-sensitive materials of the present invention could also provide an excellent image from a negative such as HG100 other than Fuji Color Super G400 Ace or Super Gold 100, 200 and 400 produced by Eastman Kodak Co.

EXAMPLE 2

Preparation of Light-Sensitive Silver Halide Emulsion:

Light-Sensitive Silver Halide Emulsion (11) (for red-sensitive emulsion layer):

To a well stirred aqueous gelatin solution (obtained by adding 800 g of gelatin, 12 g of potassium bromide, 80 g of sodium chloride and 1.2 g of Compound (a) into 26.3 l of water and kept at 53° C.), Solution (I) shown in Table 9 was added at the same flow rate over 9 minutes and Solution (II) was added at the same flow rate over 19 minutes and 10 seconds starting from 10 seconds before the addition of Solution (1). After 36 minutes, Solution (III) shown in Table 9 was further added at the same flow rate over 24 minutes and Solution (IV) was added simultaneously with Solution (III) at the same flow rate over 25 minutes.

The mixture was washed with water and desalted according to a usual method, 880 g of a lime-processed ossein gelatin, 2.8 g of Compound (b) and 118 ml of Compound (c) were added, the pH was adjusted to 6.0, optimal chemical sensitization was conducted at 60° C. for 71 minutes by adding 2.8 g of a ribonucleic acid decomposition product and 32 mg of trimethylthiourea, and after adding 2.6 g of 4-hydroxy-6-methyl-1,3,3a,7-tetrazaindene, 3.2 g of Dye (a), 5.1 g of KBr and 1.6 g of a stabilizer described above in sequence, the mixture was cooled. As a result, 28.1 kg of a monodispersed cubic silver chlorobromide emulsion having an average grain size of 0.35 μm was obtained.

TABLE 9

| | Solution (I) | Solution (II) | Solution (III) | Solution (IV) |
|---|---|---|---|---|
| $AgNO_3$ | 1,200 g | — | 2,800 g | — |
| $NH_4NO_3$ | 2.5 g | — | 2.5 g | — |
| KBr | — | 546 g | — | 1,766 g |
| NaCl | — | 144 g | — | 96 g |
| $K_2IrCl_6$ | — | 3.6 mg | — | — |
| | Water to make 6.5 l | Water to make 6.5 l | Water to make 10 l | Water to make 10 l |

Light-Sensitive Silver Halide Emulsion (12) (for green-sensitive emulsion layer):

To a well stirred aqueous gelatin solution (obtained by adding 20 g of gelatin, 0.3 g of potassium bromide, 2 g of sodium chloride and 3 mg of Compound (a) into 500 ml of water and kept at 45° C.), Solution (I) and Solution (II) shown in Table 10 were added simultaneously at the same flow rate over 9 minutes. After 5 minutes, Solution (III) and Solution (IV) shown in Table 10 were added simultaneously at the same flow rate over 32 minutes. One minute after completion of the addition of Solutions (III) and (IV), 60 ml of a methanol solution of dyes (containing 360 mg of Dye (b1) and 73.4 mg of Dye (b2)) was collectively added.

The mixture was washed with water and desalted (conducted using precipitant (a) at a pH of 4.0) according to a usual method, 22 g of a lime-processed ossein gelatin was added, the pH and the pAg were adjusted to 6.0 and 7.6, respectively, by adding NaCl and NaOH each in an appropriate amount, optimal chemical sensitization was conducted at 60° C. by adding 1.8 mg of sodium thiosulfate and 180 mg of 4-hydroxy-6-methyl-1,3,3a,7-tetrazaindene, and after adding 90 mg of Antifoggant (1), the mixture was cooled. Furthermore, 70 mg of Compound (b) and 3 ml of Compound (c) were added as antiseptics. As a result, 635 g of a monodispersed cubic silver chlorobromide emulsion having an average grain size of 0.30 μm was obtained.

TABLE 10

| | Solution (I) | Solution (II) | Solution (III) | Solution (IV) |
|---|---|---|---|---|
| $AgNO_3$ | 10.0 g | — | 90.0 g | — |
| $NH_4NO_3$ | 0.06 g | — | 0.38 g | — |
| KBr | — | 3.50 g | — | 57.1 g |
| NaCl | — | 1.72 g | — | 3.13 g |
| $K_2IrCl_6$ | — | — | — | 0.03 mg |
| | Water to make 126 ml | Water to make 131 ml | Water to make 280 ml | Water to make 289 ml |

Light-Sensitive Silver Halide Emulsion (13) (for blue-sensitive emulsion layer):

To a well stirred aqueous gelatin solution (obtained by adding 1.582 g of gelatin, 127 g of KBr and 660 mg of Compound (a) into 29.2 l of water and kept at 72° C.), Solutions I and II each having the composition shown in Table 11 were added such that Solution II was added and 10 seconds after then, Solution I was added, each over 30 minutes. Two minutes after completion of the addition of Solution I, Solution V was added, 5 minutes after completion of the addition of Solution II, Solution IV was added, and 10 seconds after then, Solution III was added. Solution III was added over 27 minutes and 50 seconds and Solution IV was added over 28 minutes.

Thereafter, the mixture was washed with water and desalted (conducted using 32.4 g of Precipitant (b) at a pH of 3.9), the pH and the pAg were adjusted to 6.1 and 8.4 by adding 1.230 g of a lime-processed ossein gelatin and 2.8 g of Compound (b), optimal chemical sensitization was conducted at 65° C. for about 70 minutes by adding 24.9 mg of sodium thiosulfate, and after adding 13.1 g of Dye (c) and 118 ml of Compound (c) in sequence, the mixture was cooled. In the thus-obtained emulsion, the silver halide grains were a potato-like grain and the grain size was 0.53 μm. The yield was 30.7 kg.

TABLE 11

| | Solution (I) | Solution (II) | Solution (III) | Solution (IV) | Solution (V) |
|---|---|---|---|---|---|
| $AgNO_3$ | 939 g | — | 3,461 g | — | — |
| $NH_4NO_3$ | 3.4 g | — | 15.4 g | — | — |
| KBr | — | 572 g | — | 2,464 g | — |
| KI | — | — | — | — | 22.0 g |
| | Water to make 6.69 l | Water to make 6.68 l | Water to make 9.70 l | water to make 9.74 l | Water to make 4.40 l |

The gelatin dispersion of Compound (d), the dispersion of zinc hydroxide, and the gelatin dispersions of dye-donating compounds were prepared in the same manner as in Example 1.

Using these, Heat-Developable Light-Sensitive Material 1001 was prepared to have a structure shown in Table 12.

TABLE 12

Structure of Light-Sensitive Material (Light-Sensitive Material 1001)

| Layer No. | Name of Layer | Additives | Coated Amount ($g/m^2$) |
|---|---|---|---|
| Seventh Layer | Protective Layer | Acid-processed gelatin | 0.387 |
| | | PMMA Matting agent | 0.017 |
| | | Surface Active Agent (2) | 0.006 |
| | | Surface Active Agent (3) | 0.016 |
| Sixth Layer | Interlayer | Gelatin | 0.763 |
| | | $Zn(OH)_2$ | 0.558 |
| | | Surface Active Agent (3) | 0.002 |
| | | Compound (d) | 0.036 |
| | | Compound (f) | 0.011 |
| | | Compound (g) | 0.022 |
| | | Compound (h) | 0.005 |
| | | High Boiling Point Organic Solvent (1) | 0.107 |
| | | $Ca(NO_3)_2$ | 0.012 |
| | | Surface Active Agent (3) | 0.022 |
| | | Water-Soluble Polymer (1) | 0.003 |
| Fifth Layer | Blue-sensitive Layer | Silver Halide Emulsion (13) | 0.399 in terms of silver |
| | | Gelatin | 0.532 |
| | | Yellow Dye-Donating Compound (15) | 0.348 |
| | | Compound (d) | 0.054 |
| | | Compound (h) | 0.021 |
| | | Compound (j) | 0.091 |
| | | Compound (k) | 0.045 |
| | | High Boiling Point Organic Solvent (1) | 0.391 |
| | | Surface Active Agent (1) | 0.021 |
| | | Water-Soluble Polymer (1) | 0.006 |
| Fourth Layer | Interlayer | Gelatin | 0.467 |
| | | $Zn(OH)_2$ | 0.341 |
| | | Surface Active Agent (3) | 0.001 |
| | | Compound (d) | 0.022 |
| | | Compound (f) | 0.007 |
| | | Compound (g) | 0.014 |
| | | Compound (h) | 0.003 |
| | | High Boiling Point Organic Solvent (1) | 0.066 |
| | | $Ca(NO_3)_2$ | 0.008 |
| | | Surface Active Agent (1) | 0.014 |
| | | Water-Soluble Polymer (1) | 0.002 |

TABLE 12-continued

| | | Structure of Light-Sensitive Material (Light-Sensitive Material 1001) | |
|---|---|---|---|
| Third Layer | Green-Sensitive Layer | Silver Halide Emulsion (12) | 0.234 in terms of silver |
| | | Gelatin | 0.311 |
| | | Magenta Dye-Donating Compound (B) | 0.357 |
| | | Compound (m) | 0.004 |
| | | Compound (h) | 0.004 |
| | | High Boiling Point Organic Solvent (2) | 0.178 |
| | | Surface Active Agent (1) | 0.010 |
| | | Water-Soluble Polymer (1) | 0.008 |
| Second Layer | Interlayer | Gelatin | 0.513 |
| | | Surface Active Agent (4) | 0.069 |
| | | Surface Active Agent (3) | 0.007 |
| | | Compound (d) | 0.022 |
| | | Compound (f) | 0.007 |
| | | Compound (g) | 0.014 |
| | | Compound (h) | 0.003 |
| | | High Boiling Point Organic Solvent (1) | 0.066 |
| | | $Ca(NO_3)_2$ | 0.004 |
| | | Water-Soluble Polymer (1) | 0.020 |
| First Layer | Red-Sensitive Layer | Silver Halide Emulsion (11) | 0.160 in terms of silver |
| | | Gelatin | 0.294 |
| | | Cyan Dye-Donating Compound (A1) | 0.141 |
| | | Cyan Dye-Donating Compound (A2) | 0.211 |
| | | Compound (i) | 0.041 |
| | | Compound (h) | 0.020 |
| | | High Boiling Point Organic Solvent (1) | 0.060 |
| | | High Boiling Point Organic Solvent (2) | 0.138 |
| | | Surface Active Agent (1) | 0.015 |
| | | Water-Soluble Polymer (1) | 0.017 |
| | | Stabilizer | 0.005 |
| | | Hardening agent | 0.035 |
| Support (1) | Polyethylene-laminated paper support (thickness: 131 μm) | | |

Support (1):

| Name of Layer | Composition | | Layer Thickness (μm) |
|---|---|---|---|
| Surface Undercoat Layer | Gelatin | | 0.1 |
| Surface PE Layer (glossy) | Low-density polyethylene (density: 0.923): | 89.2 parts | 36.0 |
| | Surface-treated titanium oxide: | 10.0 parts | |
| | Ultramarine: | 0.8 part | |
| Pulp Layer | Wood free paper (LBKP/NBKP = 1/1, density: 1.080) | | 64.0 |
| Back PE Layer (mat) | High-density polyethylene (density: 0.960) | | 31.0 |
| Back Undercoat Layer | Gelatin | | 0.05 |
| | Colloidal Silica | | 0.05 |
| | | | Total 131.2 |

Image-Receiving Material R201 was prepared in the same manner as in Example 1.

Light-Sensitive Silver Halide Emulsion (14) of the Invention (for green-sensitive emulsion layer):

Silver Halide Emulsion (14) was prepared thoroughly in the same manner as Light-Sensitive Silver Halide Emulsion (12), except that 100 ml of a 1% aqueous solution of potassium iodide was added 11 minutes after initiation of the addition of Solution (III), 0.18 g of ribonucleic acid decomposition product was added in the first of chemical sensitization and the addition amount of sodium sulfate was optimized and changed to 4.2 mg.

Light-Sensitive Silver Halide Emulsion (15) for Comparison (for green-sensitive emulsion layer):

Silver Halide Emulsion (15) was prepared thoroughly in the same manner as Light-Sensitive Silver Halide Emulsion (14), except for adding 100 ml of water 11 minutes after initiation of the addition of Solution (III).

Light-Sensitive Silver Halide Emulsion (16) for Comparison (for green-sensitive emulsion layer):

Silver Halide Emulsion (16) was prepared thoroughly in the same manner as Light-Sensitive Silver Halide Emulsion (14), except that the ribonucleic acid decomposition product was not added in the first of chemical sensitization and the addition amount of sodium thiosulfate was optimized and changed to 2.4 mg.

Light-Sensitive Materials 1002 to 1004 were each prepared in the same manner as Light-Sensitive Material 1001, except for using Light-Sensitive Silver Halide Emulsion (14) of the Invention, Light-Sensitive Silver Halide Emulsion (15) for Comparison or Light-Sensitive Silver Halide Emulsion (16) for Comparison in place of Light-Sensitive Silver Halide Emulsion (12) of Light-Sensitive Material 1001.

Light-Sensitive Materials 1001 to 1004 were each subjected to the following pressure test, exposure and processing to evaluate the pressure property.

Onto the back surface and the front surface of each of Light-Sensitive Materials 1001 to 1004, a pressure was carefully applied with a needle having a diameter of 0.5 μm or 1.0 μm under a load of about 50 g so that the layer surface on the front surface was not scarred. Thereafter, each material was exposed to a tungsten lamp through an equivalent neutral density filter with the density being continuously varied and a CC filter for color correction manufactured by Fuji Photo Film Co., Ltd., at 2,500 lux for 1/10 second so that the gray density was colored.

Onto the emulsion surface of each exposed light-sensitive material, damping water was fed by a wire bar and then, the material was superposed on Image-Receiving Material 201 so that the layer surfaces came into contact with each other. After heating the members at a heat development temperature of 83° C. for 30 seconds, the image-receiving material was peeled off from the light-sensitive material and as a result, an image was obtained on the image-receiving material.

The pressure fog was evaluated by examining the presence or absence of flaws of magenta color on the white area of the image obtained. The change in the magenta density in the gray area was visually determined and the pressure sensitization and pressure desensitization were evaluated.

The results obtained are shown in Table 13. It is clearly seen from Table 13 that the light-sensitive material of the present invention is improved in the pressure property as compared with the light-sensitive materials for comparison.

TABLE 13

| Light-Sensitive Material | Silver Halide Emulsion added to 3rd Layer | Silver Chloride Content (%) | Silver Iodide Content and State of the Presence | Presence or Absence of Nucleic Acid Decomposition Product at Chemical Sensitization | Pressure Property of Magenta Layer: Fog | Increase in Sensitivity | Decrease in Sensitivity | Other Photographic Property |
|---|---|---|---|---|---|---|---|---|
| 1001 (Comparison) | (12) | 13 | 0% | none | poor | poor | good | |
| 1002 (Invention) | (14) | 12 | 1%, locally present inside grain | present | good | good | good | |
| 1003 (Comparison) | (15) | 13 | 0% | present | poor | poor | good | same as Sample 1001 |
| 1004 (Comparison) | (16) | 12 | 1%, locally present inside grain | none | good | good | poor | soft |

good: pressure fog, pressure sensitization and pressure desensitization were not observed.
poor: pressure fog, pressure sensitization and pressure desensitization were observed.

While the invention has been described in detail and with reference to specific embodiments thereof, it will be apparent to one skilled in the art that various changes and modifications can be made therein without departing from the spirit and scope thereof.

What is claimed is:

1. A heat developable color light-sensitive material comprising a support having provided thereon at least a light-sensitive silver halide emulsion, a binder and a dye-donating compound, wherein said light-sensitive silver halide emulsion (a)

(a-1) comprises silver halide grains containing silver iodide in an amount of 0.1 to 2 mol % or more based on silver in the inside of the grains; and (a-2) contains at least one compound represented by the following formula (I-a), (I-b) or (I-c);

or (b)

(b-1) comprises silver chloroiodobromide grains containing silver iodide in an amount of 0.1 to 2 mol % based on silver in the inside of the grains and silver chloride in an amount of 10 mol % or more based on silver;

(b-2) contains a sensitizing dye added before chemical sensitization; and (b-3) is chemically sensitized in the presence of a nucleic acid decomposition product:

$$Z—SO_2.S—M \quad \text{(I-a)}$$

$$Z-SO_2.S-M \quad \text{(I-a)}$$

-continued

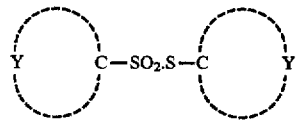

(I-b)

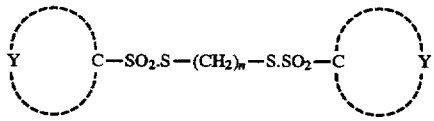

(I-c)

wherein

Z represents an alkyl group, an aryl group or a heterocyclic group, which each may be substituted;

Y represents a group necessary for forming an aromatic ring or a heterocyclic ring, which each may be substituted;

M represents a metal atom or an organic cation; and n represents an integer of from 2 to 10.

2. The heat-developable color light-sensitive material as claimed in claim 1, wherein the dye-donating compound is capable of releasing a diffusible dye in correspondence to silver development.

3. The heat-developable color light-sensitive material as claimed in claim 1, wherein said light-sensitive silver halide emulsion satisfied conditions (a-1) and (a-2).

4. The heat-developable color light-sensitive material as claimed in claim 1, wherein said light-sensitive silver halide emulsion satisfied conditions (b-1), (b-2) and (b-3).

* * * * *